US006309049B1

(12) United States Patent
Salmon

(10) Patent No.: US 6,309,049 B1
(45) Date of Patent: Oct. 30, 2001

(54) PRINTING APPARATUS AND METHOD FOR IMAGING CHARGED TONER PARTICLES USING DIRECT WRITING METHODS

(75) Inventor: Peter C. Salmon, Los Altos, CA (US)

(73) Assignee: The Salmon Group LLC, Los Altos, CA (US)

( * ) Notice: Subject to any disclaimer, the term of this patent is extended or adjusted under 35 U.S.C. 154(b) by 0 days.

(21) Appl. No.: 09/239,604

(22) Filed: Jan. 29, 1999

Related U.S. Application Data

(60) Provisional application No. 60/075,025, filed on Feb. 18, 1998.

(51) Int. Cl.[7] ..... B41J 2/06

(52) U.S. Cl. ..... 347/55

(58) Field of Search ..... 347/55, 151, 120, 347/141, 154, 103, 123, 111, 159, 127, 128, 131, 125, 158; 399/271, 290, 292, 293, 294, 295

(56) References Cited

U.S. PATENT DOCUMENTS

| | | | |
|---|---|---|---|
| 3,778,678 | | 12/1973 | Masuda . |
| 3,801,869 | | 4/1974 | Masuda . |
| 3,872,361 | | 3/1975 | Masuda . |
| 4,527,884 | | 7/1985 | Nusser . |
| 4,568,955 | | 2/1986 | Hosoya et al. . |
| 4,647,179 | | 3/1987 | Schmidlin . |
| 4,743,926 | | 5/1988 | Schmidlin et al. . |
| 4,777,500 | | 10/1988 | Salmon . |
| 4,780,733 | | 10/1988 | Schmidlin . |
| 5,030,976 | | 7/1991 | Salmon . |
| 5,153,617 | | 10/1992 | Salmon . |
| 5,281,982 | | 1/1994 | Mosehauer et al. . |
| 5,287,127 | | 2/1994 | Salmon . |
| 5,400,062 | | 3/1995 | Salmon . |
| 5,519,520 | * | 5/1996 | Stoller . |
| 5,879,572 | * | 3/1999 | Folsom et al. . |

FOREIGN PATENT DOCUMENTS

| | | |
|---|---|---|
| 0780740A1 | 6/1997 | (EP) . |
| 62292449 | 12/1987 | (JP) . |

* cited by examiner

*Primary Examiner*—Raquel Yvette Gordon
(74) *Attorney, Agent, or Firm*—Flehr Hohbach Test Albritton & Herbert LLP

(57) ABSTRACT

Direct writing method and apparatus and methods for imaging charged toner particles directly to a print receiving medium. The charged toner particles are imaged directly to a print receiving medium using one electronic writing head for each color. The writing heads employ voltage traveling waves to convey toner in the form of toner packets to toner transport channels. The size of the toner packets is controlled by using additive or subtractive methods to perform imaging.

33 Claims, 18 Drawing Sheets

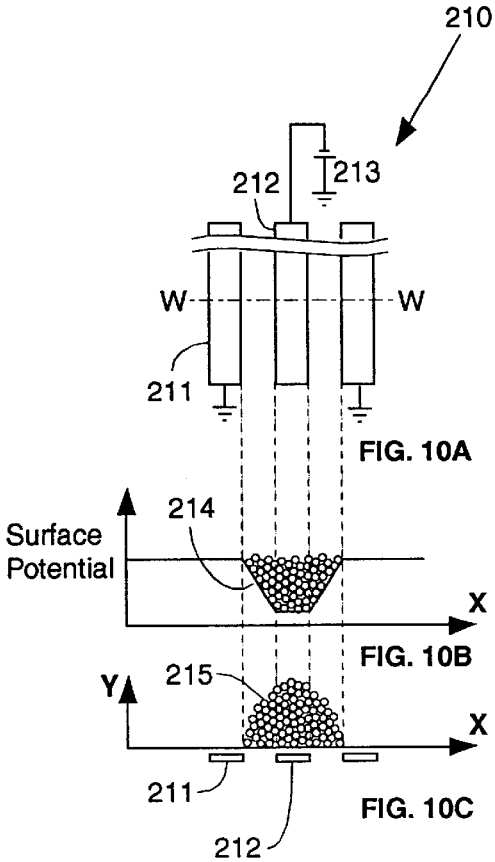
210
212
213
W
W
211
FIG. 10A
Surface Potential
214
X
FIG. 10B
Y
215
X
211
212
FIG. 10C
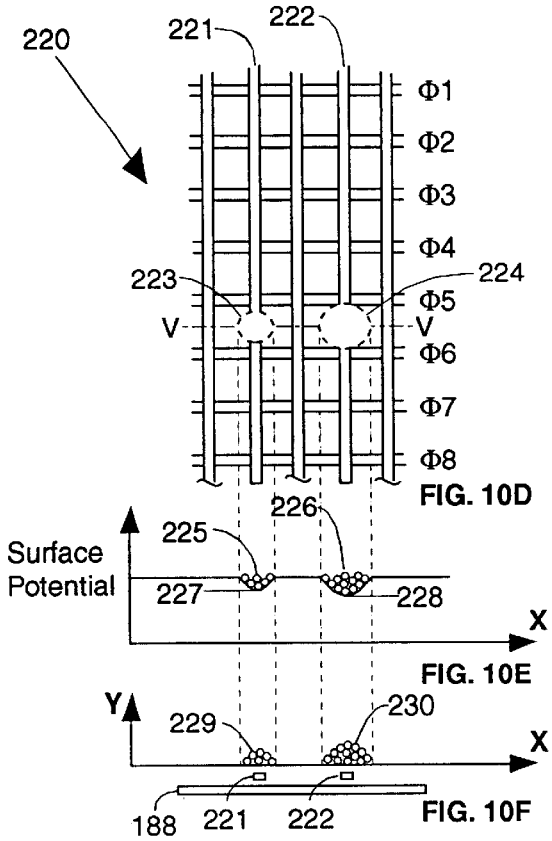
220
221
222
Φ1
Φ2
Φ3
Φ4
223
224
Φ5
V
V
Φ6
Φ7
Φ8
FIG. 10D
226
Surface Potential
225
227
228
X
FIG. 10E
Y
229
230
X
188
221
222
FIG. 10F
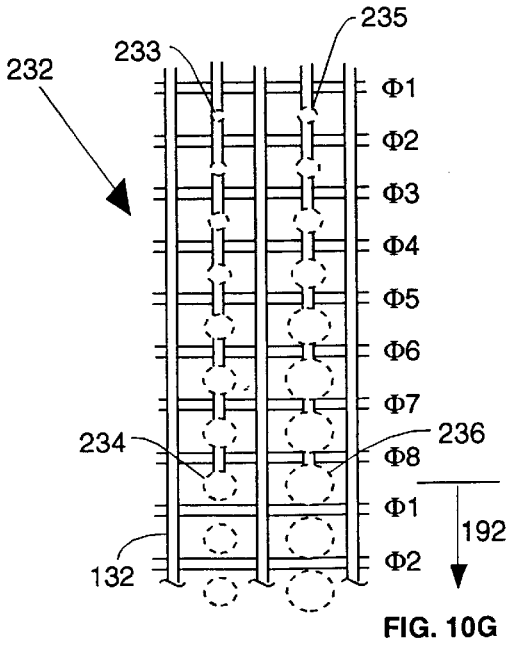
235
233
232
Φ1
Φ2
Φ3
Φ4
Φ5
Φ6
Φ7
234
236
Φ8
Φ1
192
132
Φ2
FIG. 10G

PRINTING APPARATUS AND METHOD FOR IMAGING CHARGED TONER PARTICLES USING DIRECT WRITING METHODS

RELATED APPLICATIONS

This application claims priority to Provisional Application Serial No. 60/075,025 filed Feb. 18, 1998, entitled "Digital Packet Printing".

BRIEF DESCRIPTION OF THE INVENTION

This invention relates to electrostatic printing, and more particularly to a direct wiring method and apparatus and methods for imaging charged toner particles directly to a print receiving medium.

BACKGROUND OF THE INVENTION

Of the various electrostatic printing methods, electrophotography has dominated high resolution monochrome printing for several decades. The electrophotographic process includes uniformly coating a photoconductive surface with charge, selectively exposing the charged surface with light to form a latent image, developing the latent image by causing charged toner particles to come in contact with it, transferring the image to a receiving sheet, and fixing the image. This printing method has produced high quality printing and has been refined to effectively service a broad range of printing applications. However, it is mechanically complex, requires precision optical components, and has proven difficult to adapt to color printing.

Direct Electrostatic Printing (DEP) can be simpler than electrophotographic printing. In U.S. Pat. No. 3,689,935, Pressman et al. disclose a DEP device in which toner is deposited directly through apertures onto a plain paper substrate in image configuration. This method has been improved by Schmidlin in U.S. Pat. No. 4,912,489 issued Mar. 27, 1990 in which a control voltage as low as 100 V is sufficient to modulate the flow of toner through the apertures. The Schmidlin device employs a traveling wave conveyor to present toner to the print head apertures. U.S. Pat. No. 3,113,042 issued to Hall in 1963 describes a magnetic toner conveyor for use as a developer unit in a xerographic printer. Magnetic powder is transported from a toner reservoir to develop a latent image on a xerographic plate or drum. The conveyor has a linear structure with multiple phases driven by current sources to magnetically convey the toner. U.S. Pat. No. 3,778,678 issued to Masuda in 1974 describes a voltage traveling wave device for moving particles along a tubular duct. The electrodes are spirally wound along the outer surface and are connected to a three-phase alternating current source of 5–10 kV, which repels the particles from the inner surface and propels them along the tube. In U.S. Pat. No. 3,801,869, Masuda also describes a grid of planar spaced-apart electrodes covering the wall of a paint booth for transporting paint particles for the purpose of removing paint from the wall. U.S. Pat. No. 4,527,884 issued to Nusser in 1985 describes a device for applying toner to an electrostatic charge image carried on an information carrier. The apparatus employs a traveling wave conveyor to transport the toner in the form of an aerosol to the information carrier where a development gap is created between the surface of the traveling wave conveyor and the information carrier. Toner is transferred across the gap to the information carrier to develop the image. U.S. Pat. No. 4,568 issued to Hosoya et al. in 1986 describes the use of a three-phase traveling wave conveyor to create a toner fog at the surface of a developer carrier. U.S. Pat. No. 4,647,179 issued to Schmidlin describes apparatus employing traveling wave transport of the toner. In 1989, Melcher et al. (J. R. Melcher, E. P. Warren, and R. H. Kotwal, "Theory for pure-traveling wave boundary-guided transport of triboelectrified particles", *Particle Sci. Technol.*, vol. 7, no. 1, 1989) (J. R. Melcher et al, "Traveling-wave delivery of single component developer", *IEEE Trans. Industry Applications*, vol. 25, no. 5, pp. 956–961, September /October 1989) provided additional understanding of the modes of transport that are achievable with voltage traveling waves. In 1990 Schmidlin (Fred W. Schmidlin, "A new nonlevitated mode of traveling wave toner transport", paper IUSD 89-62, approved by the Electrostatic Process Committee of the IEEE Industrial Applications Society for presentation at the 1989 Industry Applications Society annual meeting, Pittsburgh, Pa. Oct. 2–7, 1989, and released for publication Dec. 6, 1990) published a description of a charged toner conveyor wherein the particles are not levitated and are carried synchronously with the traveling wave.

The aforementioned patents and other publications on traveling wave toner conveyors address their use for conveying toner, but not for imaging. In U.S. Pat. Nos. 5,153,617, 5,287,127, and 5,400,062 Salmon has extended the use of traveling wave devices to imaging of toner using a variety of direct writing heads. The writing heads are typically in the form of flat panels or flex circuits that extend across the printing width, and they generally provide an independent traveling wave channel for each pixel to be printed. This direct imaging technology has become known in the industry as Digital Packet Printing, or DPP.

The present invention builds on the concept of direct writing heads employing voltage traveling waves. It describes an electrostatic toner loading apparatus and method to create a convenient source of charged toner at the surface of a planar member. The loading method causes toner particles mixed with air to periodically sweep the planar surface. The particles are available for imaging at the surface of the planar member. A feature of this approach is that the thin film circuits on the planar surface that create the toner loading action can co-exist and co-function with circuits on the same planar surface that are used to image the particles. Further, it will be shown that the imaging circuits can form images by either additive or subtractive means, providing a broad range of printer design solutions.

Another improvement in this application is the provision of barrier electrodes to channel the toner flow into pixel-wide columns corresponding to the pixels across the image formed on a receiving sheet. Toner flow in each channel may be individually modulated to further create pixels in the process direction and gray-levels within each pixel. Once a modulated flow of toner packets or pixels is created in each channel by additive or subtractive means as described herein, the barrier electrodes help to keep toner packets segregated into pixel-wide columns and prevent crosstalk between adjacent channels. In summary, the barrier electrodes channelize toner transport on a surface, and minimize cross-talk between the channels.

A further improvement described in this patent application is the use of Cyclotene as a topcoat layer for the imaging structures. Cyclotene has the desirable property of being essentially triboelectrically neutral to charged toner touching events. As toner is transported along a traveling wave channel, some of the particles touch or slide against the supporting surface. If touching or sliding events changed the particle charge, it would be difficult to repeatably control the charge on toner particles and therefore the electrostatic force. Conversely, if the touching events are charge neutral, the charge to mass ratio of the particles remains relatively constant, and the fields asserted by the voltage traveling waves and the imaging electrodes control and move the toner in consistent and predictable ways.

In 1985 Hosoya et al. describe a xerographic developer unit for single component non-magnetic toner employing a regulating plate pressed against a donor roll to meter the toner into a thin layer and to charge it triboelectrically. They describe its use in non-contact development of a photoconductive drum. The effects of surface roughness, plate pressure, and bias voltage are described.

A similar device serves as a loading apparatus. For the current invention, what is needed is well charged toner that can be presented to a writing head. There are multiple triboelectric charging units developed by others that meet these requirements, as well as some that charge the toner using corona fields.

OBJECTS AND SUMMARY OF THE INVENTION

It is an object of the present invention to provide a solid state printing device, i.e., a printer wherein the print function is achieved primarily by solid state electronics rather than by electromechanical means.

It is an object of the present invention to provide a high performance printing apparatus and method using simple parts and processes.

It is another object of the present invention to provide an apparatus having excellent color accuracy and repeatability, both short-tern during a printing run, and long-term from day to day and month to month, this accuracy and repeatability being achieved by implementing digital imaging algorithms in a machine capable of operating under digital control.

It is another object of the present invention to provide an apparatus and method for continuous tone printing by implementing sixteen or more gray levels at each pixel site with a print resolution of 600 or more pixels per inch.

It is a further object of the present invention to provide a printing apparatus having high levels of reliability compared with current xerographic printers. This is a consequence of implementing most of the printing functions in electronic hardware, rather than the electromechanical and optical assemblies required for xerographic printers.

It is a further object of the present invention to provide a print engine that is small in size, light in weight, and quiet in operation.

It is a further object of the present invention to provide printers and copiers capable of high duty-cycle operation (300,000 pages per month or more), and also capable of operating for long periods without service.

Another object of the present invention is to create a method for electrostatically loading toner particles that provides a periodic brushing action of charged toner particles against a receiving surface that can be further configured with toner imaging structures. It is a related object to provide the toner particles in a form that is easily imaged, namely in an aerosol of toner particles mixed with air. A further object of the loading method is to manage wrong sign toner, WST, in a manner that prevents WST from reaching and interacting with the writing head.

The foregoing and other objects of the invention are achieved in a printing system that employs direct writing heads; each contained in a print cartridge. Each print cartridge includes a toner cartridge, a toner charging cartridge, and a writing head, and each of these can be separately replaced. In four-color printing, a print cartridge is provided for each of the process colors: cyan, yellow, magenta, and black. They are assembled within a precision frame to provide a four-color writing head module. Each writing head is capable of continuously imaging toner, which streams off a transfer edge to a receiving sheet. A single black-and-white writing head or a four-color writing head module is positioned above a dielectric belt. The dielectric belt carries a print-receiving medium such as paper or transparency, such that the medium is precisely located opposite the transfer points of the one or more writing heads. Mechanisms are provided to compensate for varying medium thickness. In one embodiment, blank sheets are retrieved from paper trays or from a bypass feed for thick sheets. The bypass feed employs a straight paper path that is desirable for stiff printing substrates, to avoid bending the substrate during paper feeding. After passing by the one or more writing heads, the print receiving sheet separates from the dielectric belt and passes through a fuser, and is subsequently ejected from the print engine.

The printing method of the current invention includes four steps: imaging, transporting, transferring, and fixing. The imaging step causes toner from a suitable source to form into image-bearing toner packets on a writing head. The transport step conveys the image-bearing toner packets on the writing head to a transfer region adjacent the image-receiving member. The transfer step causes the toner packets to transfer from the writing head to the image-receiving member, while maintaining the integrity of the image. The fixing step fuses the toner to the image-receiving member.

The printing system is compatible with optional input devices such as a high capacity input device, and also with optional output devices such as sorters, staplers, booklet makers, and other finishing devices.

Because of its small size, the four-color engine can be located adjacent to a computer system board connected to an operator console, with convenient access to all the components that may require service. An optional scanning device may be added to provide the capability to print copies from optical originals.

The ability to transport toner near a surface using voltage traveling waves, and to digitally image the toner particles as they move along a traveling wave structure, is a powerful and general capability. The apparatus and methods described herein can be applied to build printers that are fast because of their parallel architectures and precise because they implement digital imaging algorithms. In addition, because most of the printing functions are implemented electronically rather than in optical or electromechanical parts, there are several cost-related benefits. First, the development time for creation of a solid state printer of the present invention can be much shorter than for xerographic printers. This is because the methods for developing integrated circuits (ICs) and electronic assemblies are highly developed by the semiconductor and computer manufacturing industries. Second, the cost per function can be improved because of the generally lower cost per function of the electronic components compared with their electromechanical equivalents. Third, the cost of the printing system can be reduced over time using time-proven learning curves for yield improvement and cost reduction of the electronic components and their methods of assembly and testing.

BRIEF DESCRIPTION OF THE DRAWINGS

The foregoing and other objects of the invention will be more clearly understood from the description to follow when read in connection with the accompanying drawings of which:

FIG. 10A is a plan view of spaced-apart elongated electrodes used to illustrate additive imaging.

FIG. 10B is a graph of surface potential versus distance at the section WW of FIG. 10A, illustrating a potential well in the form of a trough that captures toner particles.

FIG. 10C is a side-elevational view of a pile of toner particles captured by the potential well of FIG. 10B.

FIG. 10D is an expanded view of a portion of the thin film structure of FIG. 9D with the addition of additive imaging electrodes, and shows partially completed toner packets imaged by an additive process.

FIG. 10E is a graph of surface potential versus distance at section VV of FIG. 10D.

FIG. 10F is a side-elevational view of variably sized toner piles corresponding to the potential wells of FIG. 10E.

FIG. 10G is a plan view illustration of a time sequence of packet forming events using the additive imaging process.

In the apparatus of the present invention, toner particles are delivered from a source of toner onto side-by-side parallel traveling wave toner transport channels. The toner is delivered to each toner transport channel in the form of packets of toner particles. The size of the toner packets is controlled by either an additive or a subtractive process. The packets of toner are delivered to a receiving sheet which cooperates with the ends of the channels. The packets form pixels on the receiving sheet. The intensity of each pixel is dependent upon the size of the corresponding packet or packets. The pixels form images on the receiving sheet. Thus, control of the packet size in an array of pixel-wide transport channels creates the image.

DETAILED DESCRIPTION OF THE PREFERRED EMBODIMENTS

Figure 1:
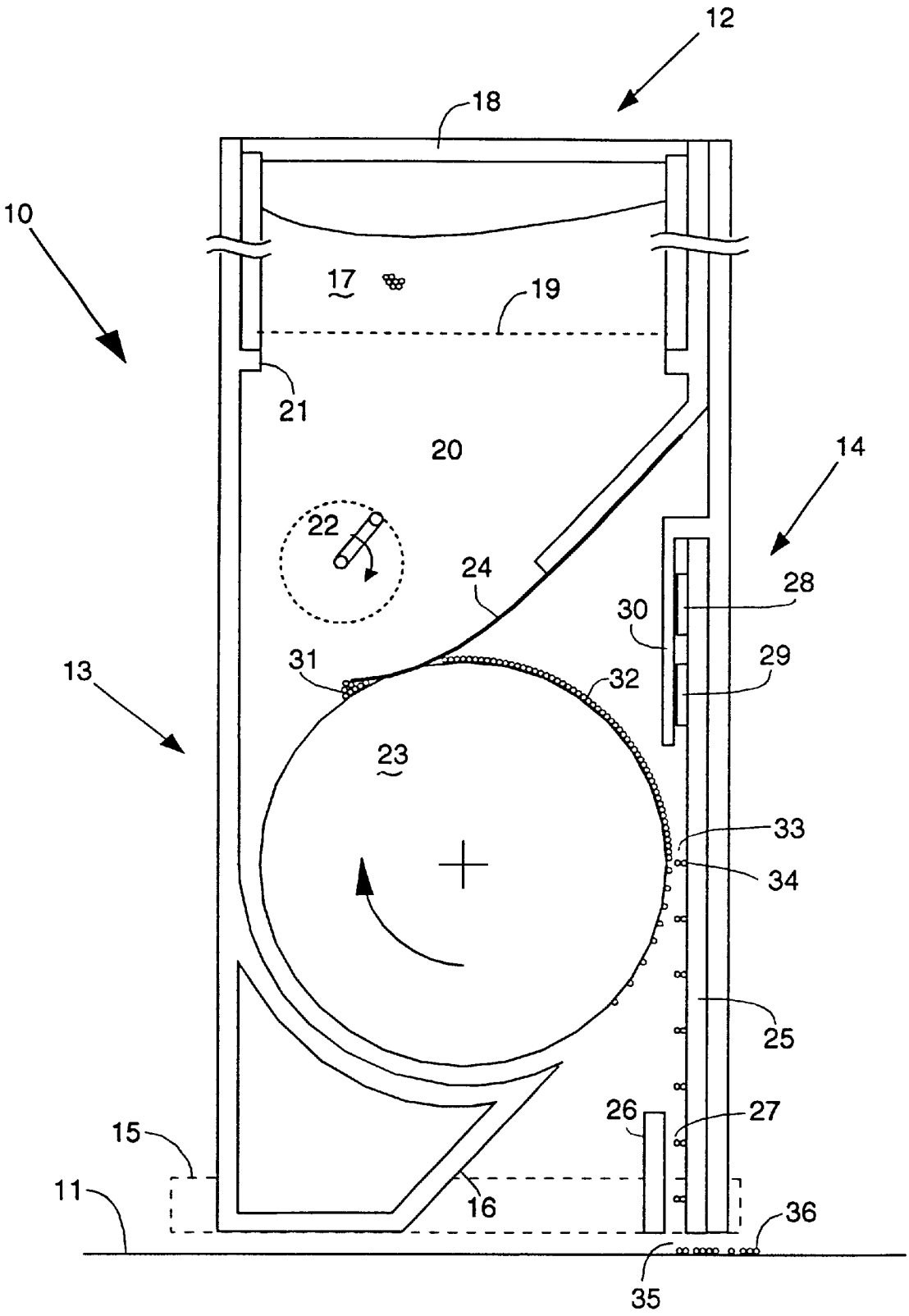
FIG. 1 is a schematic, side-elevational illustration of an apparatus representing a print cartridge of the present invention, including a toner charging cartridge, toner, and a writing head assembly.

FIG. 1 schematically shows one cartridge 10 of a printing apparatus for printing on a print medium 11 in accordance with one embodiment of the present invention. The print cartridge includes a replaceable toner cartridge 12, a separately replaceable toner charging cartridge 13, and a separately replaceable writing head assembly 14. These three elements can be inserted into precision frame 15. A single cartridge 10 is used for single color printing, and four different cartridges are used for color printing as will be further described. Generally, the elements are inserted from the top, and have locating shapes such as 16 to guide them into their precise locking positions.

Toner cartridge 12 includes toner particles 17, a protective lid 18, and a removable plastic strip 19. After inserting a new toner cartridge, the operator removes strip 19 to allow the toner to fall down into toner chamber 20. Toner cartridge 12 may also include sensors to detect the toner level (not shown), and circuits to identify the toner type installed (not shown).

Toner charging cartridge 13 includes interlocking shapes such as 21 and a rotatably mounted toner mixing device 22. Mixing device 22 fluidizes the toner powder during printing. Donor roll 23 is mounted for rotation against a flexible regulating blade 24 that charges the toner triboelectrically as is known in the art. Toner charging cartridge 13 will also include circuits to identify the cartridge type (not shown). System software will interrogate all of the modules prior to printing, and establish that the system is configured with a compatible set of replaceable modules. If a compatible set is not present, a suitable warning message will inform the user.

Writing head assembly 14 includes writing head 25 and opposing print head 26 separated by a head gap 27. Logic chips 28 and high voltage driver chips 29 may be mounted on writing head 25. The chips are suitably protected during insertion and removal such as by a protective overhang 30.

During printing operations, toner particles 31 from the chamber 20 feed into the nip formed between donor roll 23 and regulating blade 24. Blade 24 meters the toner into a thin layer, and triboelectrically charges the toner particles, as is known in the art. A thin layer of charged toner particles 32 rotates with rotating donor roll 23 and is presented to writing head 25 at the development gap 33. In one embodiment to be described in detail in the following description, gap 33 is approximately 0.2 millimeters. As will be further described, conductive thin film structures on writing head 25 are energized to attract toner particles from donor roll 23, and the toner particles will form into packets 34 which are subsequently transported along the head by traveling waves toward receiving sheet 11. The particle packets transfer across transfer gap 35 to receiving sheet 11 as will be further described, forming a monochrome multi-pixel image 36 on receiving sheet 11.

Figure 2:
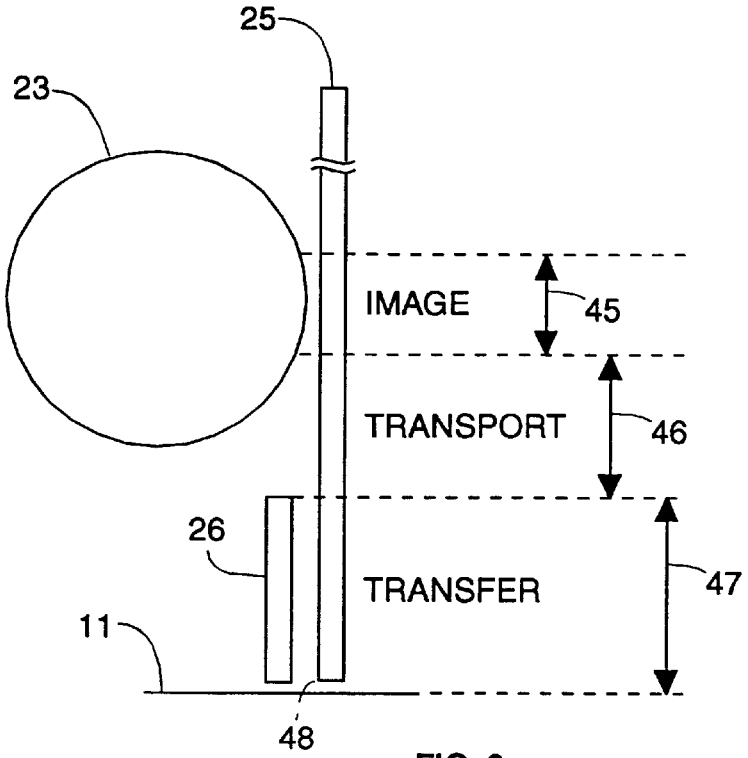
FIG. 2 is a schematic side-elevational view of a printing head showing three processing regions of the present invention: image, transport, and transfer.

FIG. 2 summarizes the printing processes occurring at writing head 25. The image is created by particles transferring from the donor roll onto the writing head in the form of toner packets at image section 45. The image-bearing packets are then transported toward the receiving sheet using voltage traveling waves from image section 45 through transport section 46 and transfer section 47. At the transfer edge 48 of the transfer section 47 of writing head 25, the packets are transferred as pixels onto receiving sheet 11.

Figure 3A:
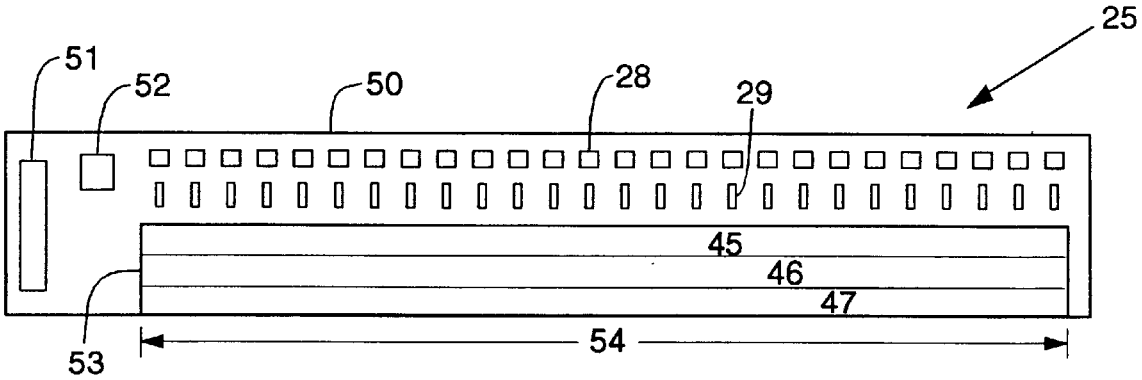
FIG. 3A is a schematic plan view of a writing head of the present invention with separate integrated circuit chips mounted on the flat panel.

FIG. 3A shows a broad outline of a writing head 25 in accordance with one embodiment of the present invention. The writing head 25 is built on substrate 50 which may be glass, ceramic, aluminum, a printed circuit board laminate, or any flat material compatible with thin film manufacture. Very small electrodes are produced on the substrate by thin film processing to form the electrodes of the writing head for high resolution printing. Typical line widths of 2–5 microns for conductive traces and typical spacing between lines of 2–5 microns are employed. In the case of printed circuit board laminate such as FR5 (NEMA-L1-1-1965 Grade FR5 General Purpose temperature and flame resistant material), the surface is prepared by spinning on multiple layers of a planarizing dielectric such as polyimide to provide a smooth enough surface prior to deposition and patterning of the thin films. Integrated circuit chips such as 28 and 29 are mounted on the panel. Integrated chips generate heat. If thermally insulating materials are used for substrate 50, it may be backed by a suitable heat sink to dissipate the heat. Pad area 51 is provided for input/output connections to a print information source. Interface chip 52 provides a logical interface between a microprocessor bus that would be typical of an information source such as a raster image processor (RIP), and data storage registers on logic chips 28. The imaging array, which comprises a plurality of parallel side-by-side channels, fills a rectangular region 53. The width 54 of the imaging array corresponds with the desired print width, which is approximately twelve inches in the preferred embodiment. Imaging array 53 is subdivided into the 3 sub-regions: imaging 45, transport 46, and transfer 47. Chips 28, 29, and 52 are assembled onto substrate 50 using an assembly technique known as chip on board. Following die attach to the substrate, wire bonding or flip-chip bonding is employed to connect the circuit traces (not shown).

Figure 3B:
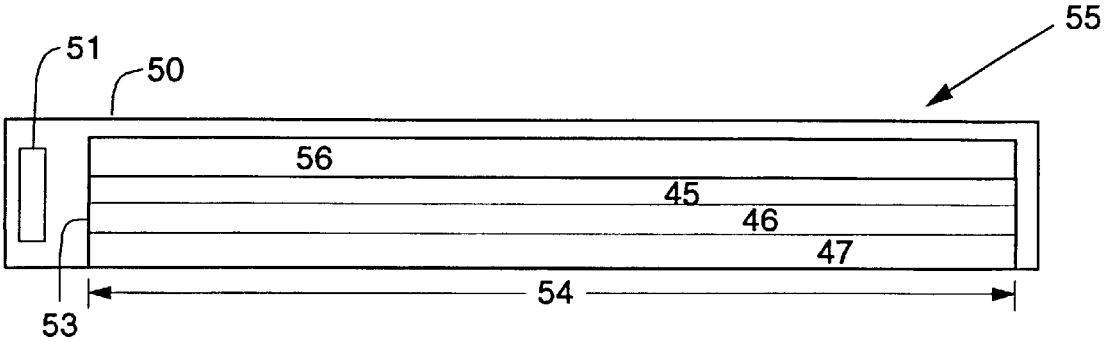
FIG. 3B is a schematic plan view of a writing head of the present invention, with the separate integrated circuit chips replaced by active transistor circuits that are integrated with the thin film structure.

FIG. 3B is an alternative embodiment of writing head 25, shown as 55. In this embodiment, the functions performed by integrated circuit chips 28, 29, and 52 are integrated into the thin film structures on the surface of the writing head. Thin film transistor (TFT) circuits have been developed on flat panels for use in flat panel displays for laptop computers and desktop computers, and are beginning to replace cathode ray tube (CRT) displays in many applications. TFT circuits represent a mature technology that can be applied to writing head 55 to reduce manufacturing cost. Logic, memory, and driver functions required for head 55 are implemented using TFT circuits that typically occupy a separate region 56 of the writing head, and generally also require additional thin film layers.

Figure 4:
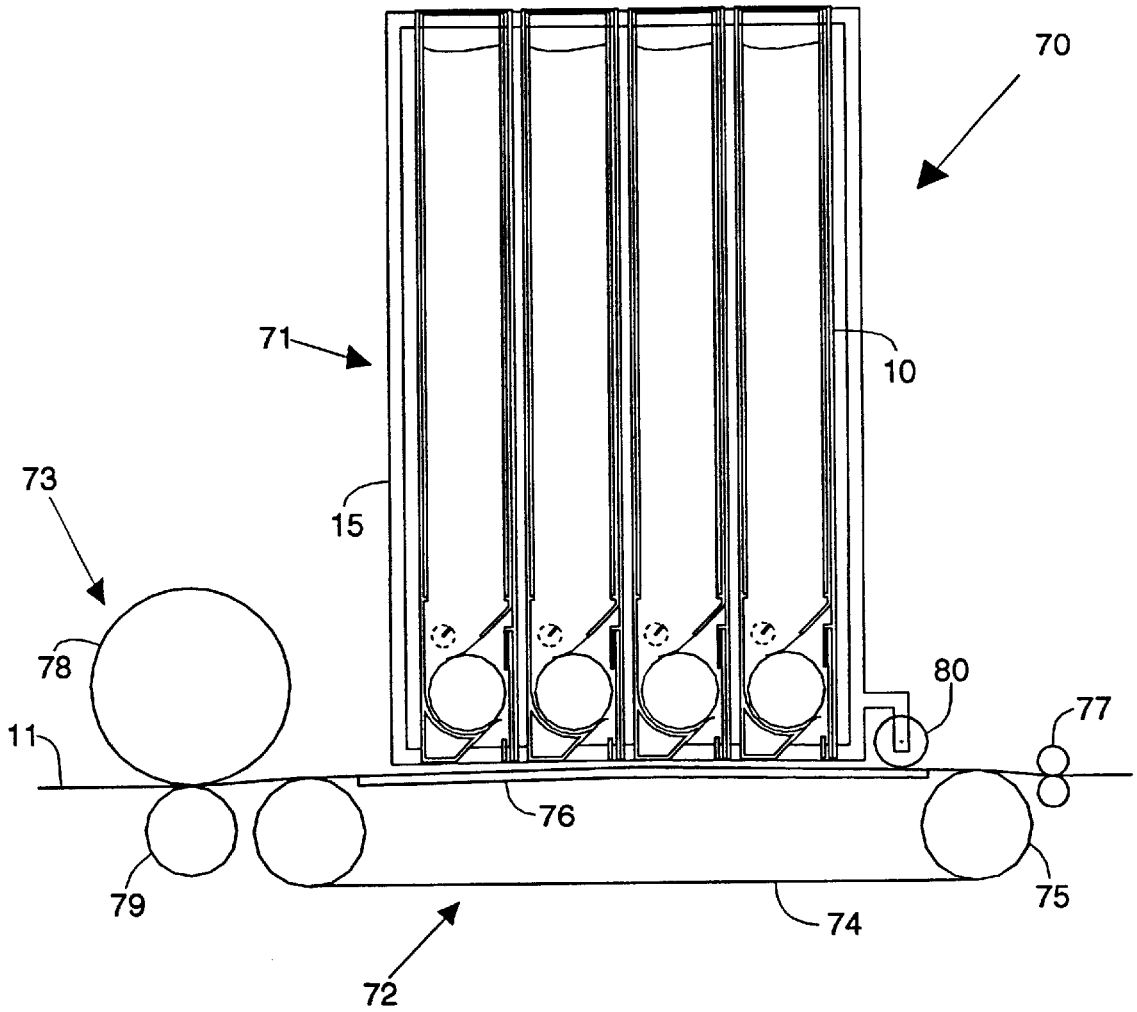
FIG. 4 is a schematic side-elevational illustration of a four-color print apparatus of the present invention employing four print cartridges.

FIG. 4 is a side view of a four color print apparatus or engine 70. The print engine 70 includes a four color writing head module 71, paper transport assembly 72, and fusing assembly 73. Module 71 is built with four of the print cartridges 10, one for each process color. Module 71 is shown enclosed by precision frame 15 and is positioned above paper transport assembly 72. Transport assembly 72 includes a dielectric belt 74 that is stretched over rollers such as 75 and a precisely curved backing plate 76. Belt 74 has an array of embedded conductors (not shown) which are connected to potentials of several hundred volts to hold down the print receiving sheets, as is known in the art. When separating the sheet from the belt, the hold-down potentials can be turned off. The frame 15 and backing plate 76 provide for a small and precise gap between the transfer edges 47 of the writing heads and opposing pixel sites on the surface of receiving sheet 11. Receiving sheets 11 feed through rollers such as 77 onto transport assembly 72. After receiving the four process color packets during a single pass of the receiving sheet past the writing heads, sheet 11 is separated from belt 74 and fed into fusing assembly 73. Fusing assembly 73 includes a hot roll 78 and a backup roll 79 as is known in the art. Since the receiving sheets 11 may vary in thickness from around 50 microns to around 300 microns and the transfer gap may be 50 microns or less, it is desirable to compensate for the thickness of each sheet. Cam mechanism 80 rides on top of the receiving sheet to sense its thickness. Other mechanisms (not shown) are required to allow module 71 to ride on sheet 11 with a constant transfer gap. As will become apparent from the description to follow, the print engine 70 of the present invention can achieve speeds of around 40 pages per minute in full color with image quality close to that of offset printing.

Figure 5:
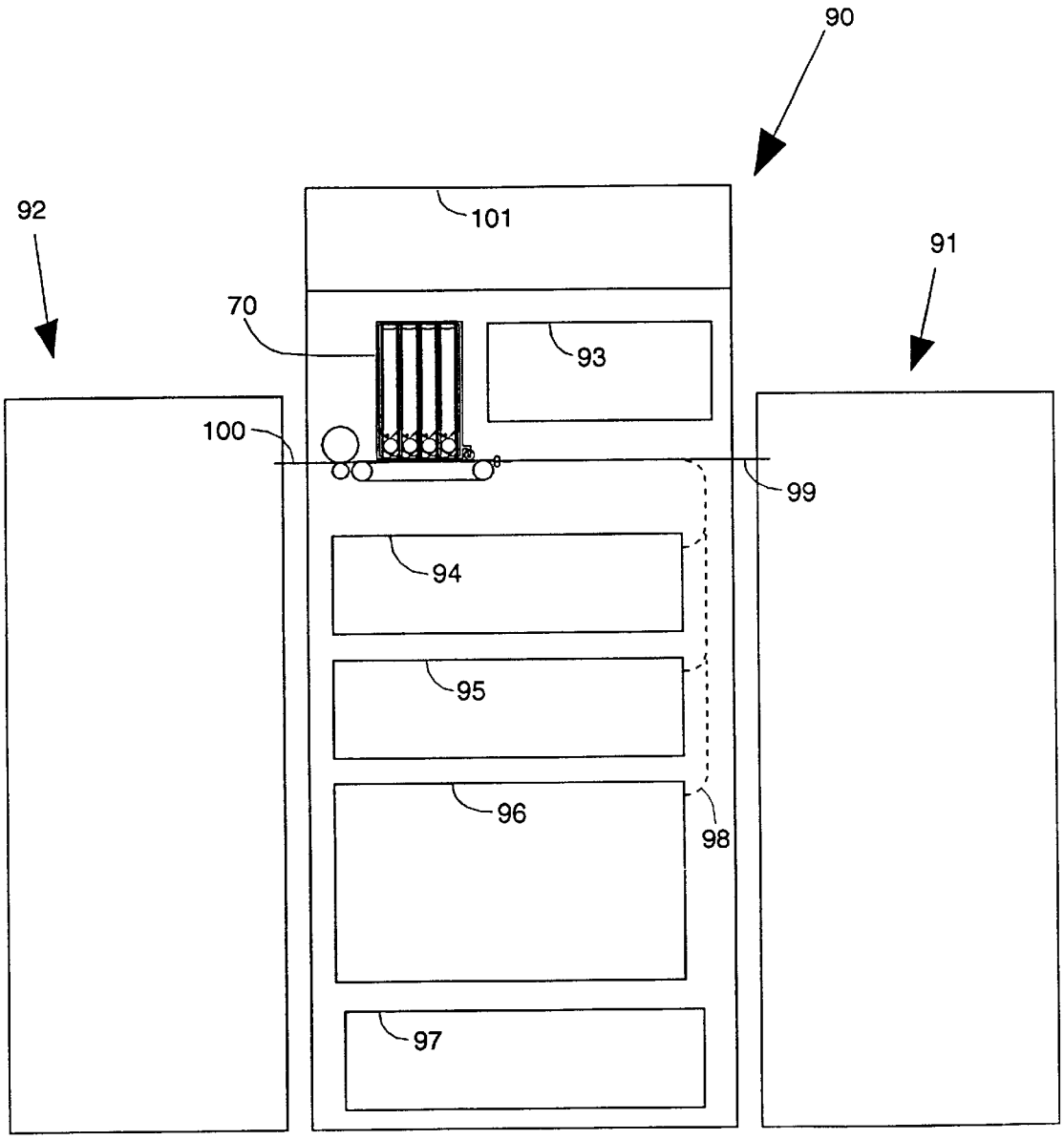
FIG. 5 is a schematic front-elevational view of a printing system of the present invention.

FIG. 5 is a front view illustration of printing system 90 incorporating the present invention. The system includes interfaces to optional media input device 91 and optional finishing device 92. Four color print engine 70 is located near the top of the system, along with host computer 93 that is connected to a control panel (not shown). This arrangement provides ready access for servicing and maintenance of print cartridges or sub-cartridges, fuser, computer modules, and control panel modules. Underneath the print engine is an array of standard paper input trays 94, 95, and 96, and system power supply 97. Receiving sheets can be retrieved from the input paper trays via paper path 98, or from bypass path 99. The bypass path can be used to accommodate thick sheets that do not bend easily, or for feeding sheets for long printing runs from an optional high capacity input device. After fusing, the receiving sheet passes by path 100 to an output tray or optional finishing device 92. An optional scanner 101 can be attached at the top of the print system for scanning optical originals for subsequent printing, thus adding the copy function to print system 90.

Figure 6A:
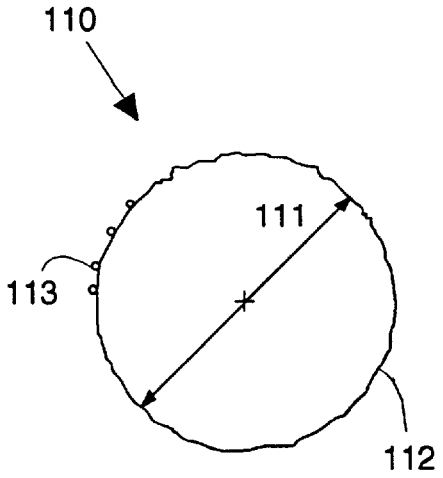
FIG. 6A is a cross-sectional illustration of a toner particle of the polymerized type.

FIG. 6A schematically shows a dry toner particle 110 manufactured by the polymerizing method. The polymerizing method of manufacture involves growing the particles in a liquid reactor, which results in their regular substantially spherical shape. A spherical shape is not always ideal in xerographic machines because of the difficulty of cleaning toner residues off of the photoconductive drum. The spherical particles tend to pass under a scraper blade instead of being scraped off. Some manufacturers have made polymerized toners with non-spherical shapes to overcome this problem. However, in printers of the present invention there is no photoconductive drum, and spherical toner particles are the preferred shape. The polymerizing method is particularly effective for manufacturing toners of small size. For example, particle 110 may have a mean diameter 111 of five microns with a standard deviation of around 2 microns. It has a surface texture 112 that is generally smooth and round, but has microscopic imperfections. Also a small fraction of the particles are not perfectly spherical. The particles may have various additives 113 such as flow control particles and charge control agents. Based on experimental data, polymerized particles such as 110 are the preferred type for traveling wave devices. The reason may lie in more uniform surface charge distribution, and higher surface mobility, when compared with the attrited toner particles described with reference to FIG. 6B.

Figure 6B:
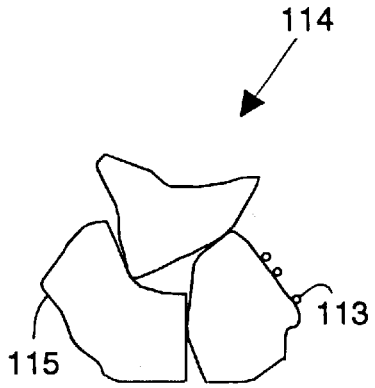
FIG. 6B is a cross-sectional illustration of several toner particles of the attrited type.

FIG. 6B shows three dry toner particles of the attrited type 114. Generally they have an irregular shape 115 arising from their method of manufacture. Attrited toners are first prepared as a hot melt, then ground or jet-milled into smaller and smaller particles, with the preferred size extracted by classification. Additives 113 are used to improve flow properties and charge uniformity, as is known in the art. In the current invention, as will be further described, only a few particles in a toner packet actually touch or interact with the underlying imaging surface at any instant in time, and also the particles that are touching are always moving on the surface. These facts enable satisfactory results using attrited toners in printers of the current invention.

For consistency, all of the descriptions in this patent assume a positive charge on the toner. This choice provides a more intuitive picture of the potential wells that capture the particles, as will be further described in relation to the additive imaging method. A typical charge to mass ratio in the preferred embodiment is 20 micro-coulombs per gram. Although negatively charged toner is more common, it is possible to achieve either toner charge polarity using various charging methods, and there is no inherent advantage to either polarity.

Figure 7A:
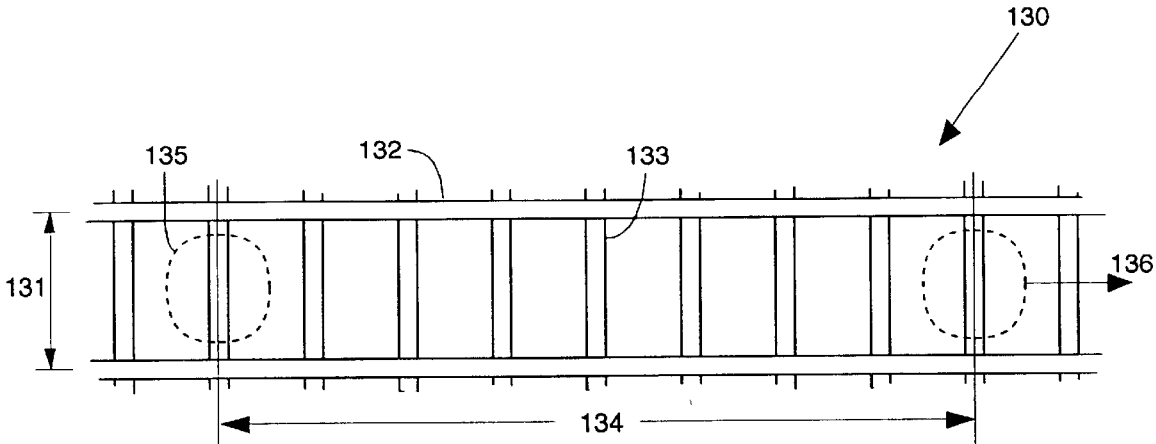
FIG. 7A is a plan layout view of a print head traveling wave channel.

FIG. 7 provides details relating to one traveling wave channel or ladder having steps 133 for transporting toner. The steps 133 are also referred to as phase electrodes. In order to provide image structure at the pixel level, a linear array of parallel traveling wave channels (see FIG. 9) is provided with each channel directing toner to a different pixel site on the receiving sheet 11. The traveling wave channel 130 may, for example, have a width 131 of forty-two microns corresponding to a pixel resolution of 600 dpi. Spaced conductive barrier electrodes 132 are shown as guardrails above the steps 133 that define the edges of each channel 130. They are connected to a positive potential to repel the positively charged toner particles. The barrier electrodes help to confine toner within the traveling wave channels, and prevent cross-talk between adjacent channels. It will be shown that each traveling wave channel 130 is an independent toner conveyor that can be configured to deliver imaged toner to a particular pixel position using electrostatic means. Orthogonal to the direction of toner transport are phase electrodes 133 which extend across the entire width 54 of the imaging array. In the present embodiment an eight phase traveling wave with a wavelength 134 of two hundred microns is used. The outline of a packet of toner particles is shown as 135. The positively charged toner particles are attracted to the most negative phase of the traveling wave, and form spontaneously into toner packets at that phase. Also, as the negative phase propagates along the channel, the toner packet continues to follow it, lagging the peak of the wave slightly due to friction. Thus the traveling wave channel becomes a synchronous electrostatic motor, dragging the charged particles along with the velocity of the voltage traveling wave. In the described embodiment, the packets have a velocity 136 of 1.0 meters per second.

Figure 7B:
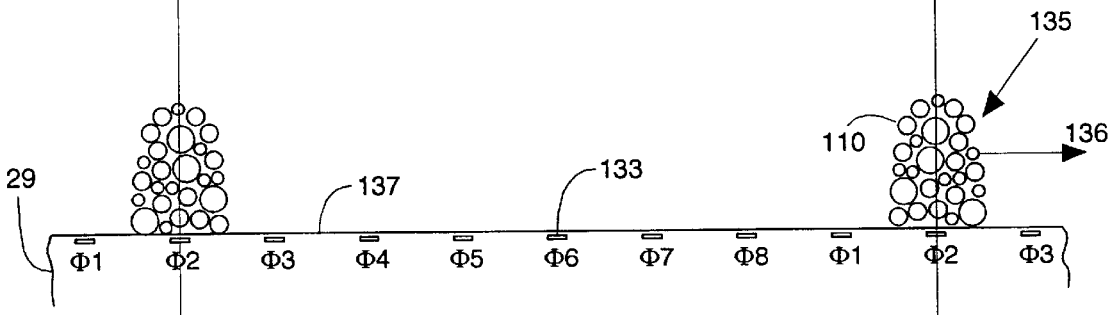
FIG. 7B is a side-elevational view of a print head traveling wave channel with associated toner packets.

FIG. 7B shows a side view of the traveling wave channel 130. The phase electrodes 133 are labeled in phase order, $\Phi 1$ through $\Phi 8$, according to the eight phase drive scheme for the channel. A profile of toner packet 135 is shown. It shows that the particles are confined by the traveling wave into a defined packet with substantial height above the surface of the channel. The packets are comprised of individual toner particles such as 110. There are approximately 150 particles in a full packet in the preferred embodiment. The electric field around the packet is produced by the voltage traveling wave. In addition to a component which drives the particles along the surface, the electric field has a vertical component which pushes the particles against surface 137. However, individual particle collisions with the surface are occurring continuously, tending to bump the particles upward. The net result is a fluid mix of particles in the packet, with only a few particles touching the surface at any point in time. The fact that only a few particles are touching the surface makes for more reliable toner transport, reducing the effects of sliding friction between the particles and the surface. In the direction of travel, the particles are confined by the traveling wave field to approximately one eighth of a wavelength. For the given geometries, this makes the packet approximately circular in horizontal cross section.

The major source of drag is aerodynamic. Computer simulations and experimental results indicate that at speeds of 1 m/s and below, there is no problem providing sufficient electrostatic drive force to overcome aerodynamic drag. In fact, significantly higher speeds should be possible if required for particular applications.

Figure 7C:
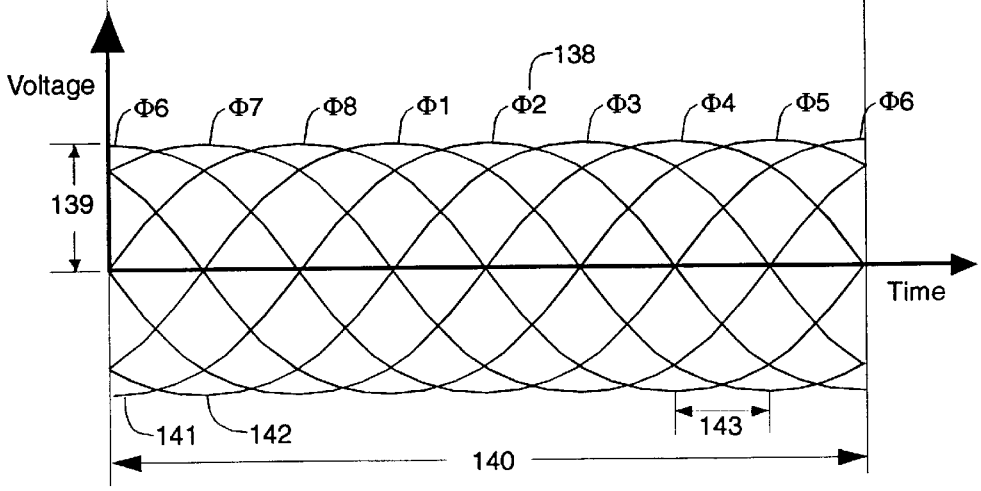
FIG. 7C is a graph of voltage versus time for example waveforms of a voltage traveling wave applied to the electrodes of the traveling wave channel implemented with eight phases.

FIG. 7C shows a composite of the eight phase voltages such as 138 superimposed versus time. The voltage amplitude 139 is around 150 volts in the preferred embodiment. Period 140 is 200 microseconds corresponding to a frequency of 5 kilohertz. Note that the packets in FIG. 6B are located at the Φ2 electrodes. Correspondingly, in FIG. 6C at time equals zero the most negative phase voltage 141 is also Φ2. By following the trace for Φ3 and looking for its most negative value, it can be seen that it will be the next position 142 for the packet. Separation 143 between phases is 45 degrees in phase and 25 microseconds in time. Other waveforms, other phases and other frequencies can be used. For example square waveforms have proven effective for traveling wave conveyors, and multi-level square waves can be useful in some applications. However, sinusoidal waveforms are believed to provide the smoothest toner motion.

Figure 8A:
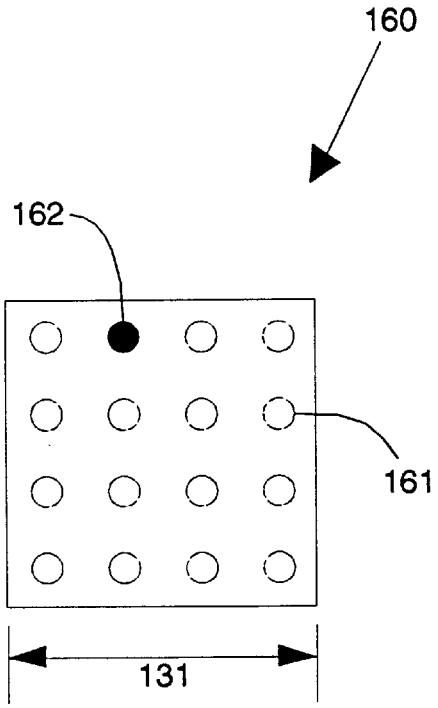
FIG. 8A is a schematic plan view of a pixel site at 600 pixels per inch, implemented with binary dots at 2400 dots per inch (dpi) representative of offset printing.
Figure 8B:
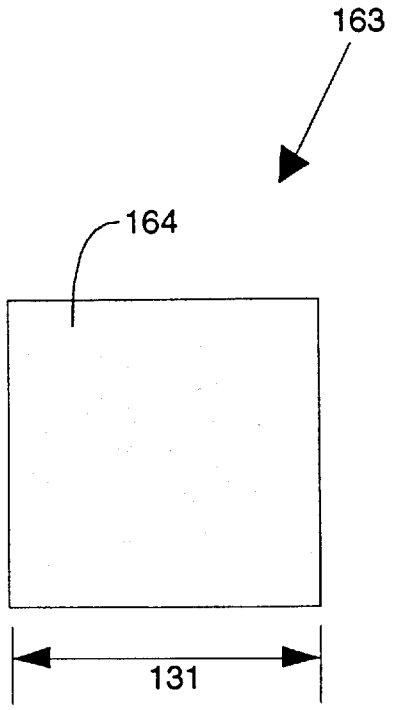
FIG. 8B is a plan view of a pixel site of the present invention, also at 600 pixels per inch.

FIG. 8 compares print quality parameters of the current invention with offset printing. FIG. 8A shows a pixel 160 comprised of a 4×4 matrix of dots at 2400 dots per inch. This is representative of offset printing. Pixel edge dimension 131 is 42 microns, corresponding to 600 pixels per inch. A spot location such as 161 may be inked or not by the offset printing plate; this is known as binary printing. By inking spots such as 162, a gray scale can be achieved with 17 values, from 0 through 16 spots. The particular spot locations printed for a desired gray scale depend on the particular half-toning algorithm employed. A particular algorithm applied to a particular image sometimes creates artifacts such as Moire patterns. FIG. 8B shows an idealized pixel produced by a printer of the present invention. It also has an edge dimension 131 of 42 microns. The pixel has a gray color 164 to indicate that its gray level can be controlled, by means to be described, to 16 levels in the preferred embodiment. The combination of pixel size and number of gray levels is essentially equivalent to offset printing, and the perceived image quality is similar.

Operation of the electrostatic toner loading apparatus 180 is described with reference to FIG. 9. The donor roll 23 provides charged toner at the surface of the writing head 25 at the image section 45 in a form that can be easily imaged, and at a rate that supports the delivery of particles sufficient for print speed. Preferably, the particles are mixed with air to create an aerosol that makes them more responsive to imaging forces. In an aerosol there will be no surface adhesion forces to overcome, as would occur if the particles were pulled directly off a donor roll. Also a fluid mix of toner in air minimizes particle to particle interactions. If the wavelength of the traveling wave is 200 microns as in the preferred embodiment, the useful electric field extends above the imaging surface by a similar distance. This means that the toner source must provide toner very close to the imaging member, essentially at the surface. If the imaging process is consuming large amounts of toner, there must be an adequate supply of new toner in the imaging space to meet the demand. On the other hand, if toner is not being consumed, perhaps because the particular toner color is not currently required, the toner should not be worn out as it waits to be imaged. The repetitive charging and discharging of toner particles that occurs in some printers is generally undesirable. The discharging process may involve mechanical scraping of the particles against a grounded blade. Over time, this can physically damage the surface of the toner particles, and can also dislodge some of the small surface particulates 113 added for flow control and charge control. If any properties of the toner are changing during operation, the imaging process will be less repeatable. As will be further explained, digital imaging algorithms are employed in the present invention. The digital algorithms and direct writing methods enable image repeatability from run to run and from day to day, far exceeding the color accuracy and repeatability achievable with xerographic printers. To realize the inherent potential for excellent long-term color accuracy and repeatability, it is important to treat the toner gently, thereby minimizing any changes in physical or electrical properties during operation.

Figure 9A:
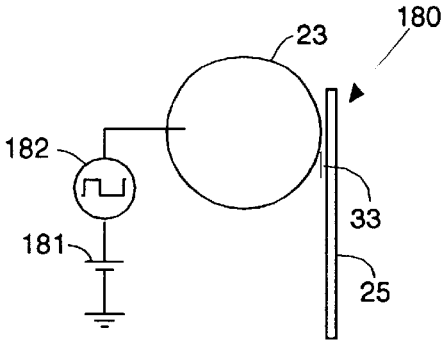
FIG. 9A is a schematic side-elevational view of an electrostatic loading apparatus of the present invention.

FIG. 9A shows a schematic side view of the electrostatic toner loading apparatus 180. Donor roll 23 is spaced from writing head 25 by development gap 33. Donor roll 23 is biased by DC bias voltage 181 in series with digital bias voltage 182. A typical value for the DC voltage 181 is a toner attracting potential of −400 volts where the toner is positively charged. The purpose of digital voltage 182 is to cause toner particles to oscillate back and forth in development gap 33 with a predetermined duty cycle to form an aerosol.

Figure 9B:
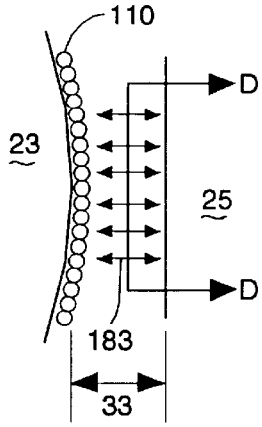
FIG. 9B is an enlarged side-elevational view of the development gap region of FIG. 9A.

FIG. 9B is an enlarged side view of development gap region 33. Toner particles such as 110 are available in a thin layer at the surface of donor roll 23. The back-and-forth oscillatory motion is shown by arrows 183. Toner particles that are not pulled off the donor roll by the electric fields, or particles that are rejected from the writing head and collected by the donor roll, rotate around with the donor roll and return to the bottom of toner chamber 20 where they merge with fresh toner particles and again become available for imaging.

Figure 9C:
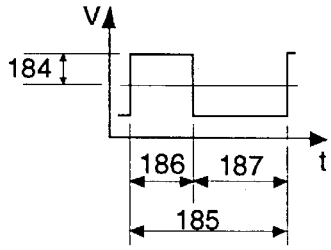
FIG. 9C is a graph of voltage versus time for an example waveform for the digital voltage bias element shown in FIG. 9A.

FIG. 9C shows a graph of voltage versus time for digital bias voltage 182. Amplitude 184 is around 500 volts. Period 185 is near that of the traveling wave, 200 microseconds in the preferred embodiment. The oscillatory action of digital voltage source 182 may be synchronized with the packet transport action of the voltage traveling wave in order to bring toner to the writing head surface at the optimal time for toner loading. The duty cycle of digital voltage 182 is one of the control factors that determine the net flux between donor roll and writing head. Portion 186 of the wave when toner is repelled from the donor roll is around 40% of period 185. Portion 187, representing 60% of the period is provided for attracting toner toward donor roll 23. This duty cycle causes the donor roll to be a net collector of any toner that is floating in the vicinity, not captured by the local traveling wave fields.

Figure 9D:
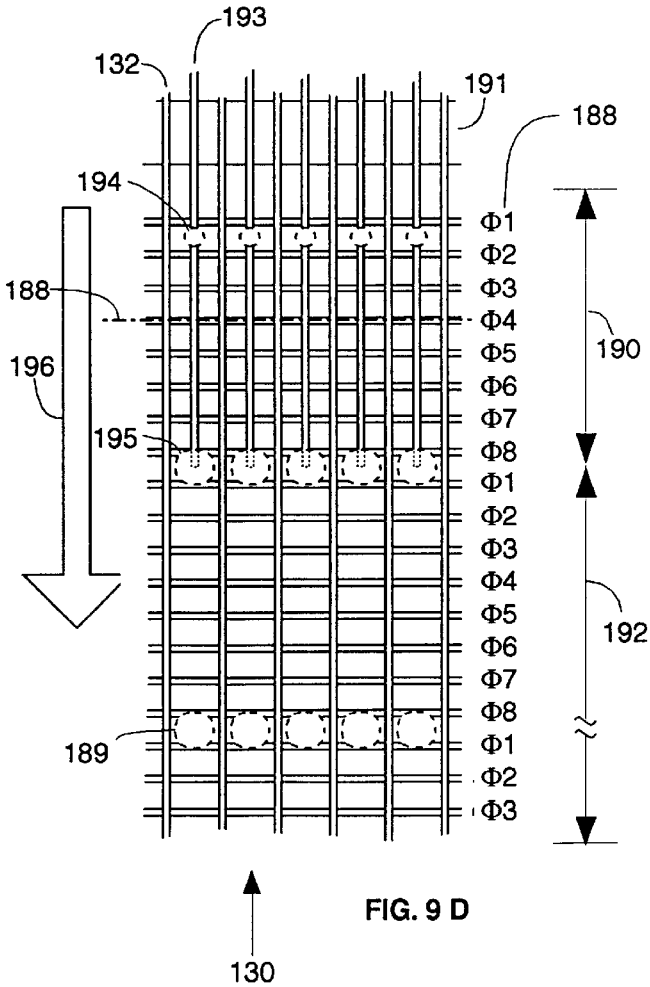
FIG. 9D is a schematic plan view of the thin film structure associated with an electrostatic loading apparatus of the present invention, represented by portion DD of FIG. 9B.

FIG. 9D is an expanded view of portion DD, FIG. 9B, of the writing head surface directly under donor roll 23. A projection of the centerline of roll 23 is shown as 188. Region 190 of the imaging array is where toner loading occurs. A large bias electrode 191 is provided at the top of the array, with a toner repelling voltage of around +300 volts in the preferred embodiment. Region 192 is a regular traveling wave transport region comprised of traveling wave channels 130, as previously described. Phase electrodes Φ1 through Φ8 span the full printing width 54. Barrier electrodes 132 are shown. For correct function of the barrier electrodes, they should repel toner particles at the points adjacent to the toner packets. To achieve repulsion of the particles, the barrier potential needs to be more positive than the peak attracting voltage of the traveling wave, which is +150 V in the preferred embodiment. Thus, the voltage applied to barrier electrodes 132 is around +200 V. Loading electrodes 193 extend the length of the loading region 190 as shown. An attractive potential of around −100 V is applied to the loading electrodes so that toner packets form in region 190. Toner packets should not form in region 192, but should be transported when delivered from region 190. Since packet formation is centered on loading electrodes 193, barrier electrodes 132 may not be necessary in region 190. It may be desirable in some applications to eliminate that portion of the barrier electrodes residing in region 190.

One cycle of operation of electrostatic toner employing toner loading apparatus 180 will now be described. Just as Φ1 is peaking at its most attractive potential, a wave of toner particles is timed to arrive from the donor roll. The instantaneous potential on the donor roll is (−400+500)=+100V and the instantaneous potential on the Φ1 electrode is (−600−150)=−750V, providing a field of 4.3 V/$\mu$ to propel particles toward the writing head. This field is applied for 80 microseconds, after which digital voltage source 182 switches polarity and the field becomes 1.3V/$\mu$ in the reverse direction for 120 microseconds. These conditions create a blanket of charged toner at region 190 of the writing head surface, with maximum toner availability during the first 80 microseconds. The blanket of toner forms into troughs centered on loading electrodes 193, as will be further described in FIG. 10. The local field surrounding the Φ1 electrode captures toner from the local trough of particles and begins to form a toner packet. This small packet forming is shown as 194. Approximately 175 microseconds later, the negative peak of the traveling wave has progressed to electrode Φ8 and the packet has grown to full size, shown as 195. The packets sweep downward as indicated by arrow 196. When the packets reach region 192 they are transported using regular voltage traveling waves as previously described. The net electric field between donor roll and writing head surface in region 192, excluding the traveling wave phase voltages, is 0.5 V/$\mu$m for 80 microseconds of the period in a direction to propel toner away from the donor roll. However, a strong field of 4.5 V/$\mu$m propels any unattached toner toward the donor roll for 120 microseconds of the period, ensuring that the donor roll does not deliver additional toner to region 192. Also, particles contained in packets traveling in channels 130 will be strongly held by the local fields of the voltage traveling wave in region 192, and will not be collected by the donor roll. As will be further discussed, subtractive imaging action may cause rejection of toner particles from the bottom edge of the region 190 of the writing head. Any particles so rejected will be collected by the closest portion of the donor roll surface. As the fully formed toner packets pass the second Φ1 electrode, a new wave of particles is being created at the first Φ1 electrode, and the whole toner loading process repeats with a 200 microsecond period in the preferred embodiment, coinciding with the periodicity of the voltage traveling wave.

It is now appropriate to discuss wrong sign toner, WST. WST is generally created in printers that employ triboelectric methods to charge the toner. If WST were to reach the writing head, it would be transported with the voltage traveling wave, 180 degrees or half a wavelength out of phase with the right sign toner. It would be delivered to the transfer edge of the writing head with a timing error corresponding to half a pixel dimension. Considering that WST typically constitutes less than 1 percent of the total toner mass, this error would probably be acceptable. However, WST would likely cause serious problems with transfer to the receiving sheet because the transfer field for right sign toner will repel WST from the receiving surface. Consequently, it is advantageous to prevent WST from reaching the writing head surface. The electrostatic toner loading apparatus is designed to achieve this. WST is weakly accelerated toward the writing head during the 60% portion 187 of digital voltage source 182 when the associated bias field is weak. The magnitude of charge on WST is generally small. The combination of weak charge and weak field means that WST will not reach the surface of the writing head. Rather it is strongly attracted to the donor roll during the 40% portion 186 of digital voltage source 182 when the bias field is strong. At the donor roll, WST particles may form doublets or triplets with right sign particles, and are subsequently recharged by regulating blade 24.

We shall now consider different methods for controlling the size of the packets or imaging the toner delivered to the transport section of the writing head surface. The first of these methods is called additive imaging because only the desired amount of toner for a given pixel site is accepted by the traveling wave channel from the donor roll, and there is no need for diverter electrodes or other means to return unwanted toner back to the donor roll. FIG. 10A shows a parallel three-electrode structure 210 that will be used to explain a simple example of additive imaging. This description for additive imaging is very similar to the toner loading method described in FIG. 9D, adding the feature of variable potentials applied to the loading electrodes to convert them into additive imaging electrodes. It is assumed that a source of toner such as the electrostatic toner source previously described is providing charged toner near the surface of the three-electrode structure. There are two outer electrodes such as 211 that are grounded, and an inner electrode 212 that is biased by DC voltage source 213 to a toner attracting potential. FIG. 10B is a graph of surface potential versus distance at position WW, and shows a potential well 214 that collects the charged toner particles. This behavior is analogous to filling a cup with water, where gravity provides the potential field and the shape of the cup defines the shape of the well. FIG. 10C shows a pile of toner 215 sitting on the imaging surface, in relation to the three-electrode structure. Toner pile 215 corresponds to a packet produced by additive imaging; defined by a potential well whose depth can be controlled by applied voltage 213.

FIG. 10D shows a portion 220 of toner loading region 190 where loading electrodes 193 have been converted to imaging electrodes 221 and 222. Image electrode 221 controls the depth of the potential well, just like electrode 212 in FIG. 10A. In this case, combining the potential field of the traveling wave with the biasing potential on image electrode 221 creates a local potential well. A gravitational analogy in this case would be pouring water into a bucket that is sliding on a plane, where the plane is being repetitively tipped with each cycle of toner loading so that the bucket slides from top to bottom, and a new bucket is created with each cycle. The depth of each bucket is controlled by the instantaneous potential on the additive imaging electrode as the associated packet is forming. The buckets are constrained to move in channels by the barrier electrodes, with one bucket per channel per cycle. Without the presence of the imaging electrodes, the useful effect of the traveling wave fields will extend above the surface to a distance of approximately one half wavelength, or 100 microns in the preferred embodiment. Note in FIG. 10D that the additive imaging electrodes 221 are shown as passing above the phase electrodes. This tends to screen the effect of the voltage wave asserted on the phase electrodes. However, at heights less than half a wavelength above the surface, where the phase electrode is not directly covered by an imaging electrode, the traveling wave fields will be sufficient to enable transport of the additive packets that are forming. It may be desirable in some applications to increase the amplitude of the phase voltages in region 190 to compensate for the screening effect of the imaging electrodes. In this case, a special set of phase electrodes would be connected to drivers supplying the increased amplitudes. In FIG. 10D note that at position VV additive packet 223 is smaller than additive packet 224. In FIG. 10E it can be seen that potential well 225 is correspondingly smaller than potential well 226, in accordance with applied potentials 227 and 228. FIG. 10F shows toner piles 229 and 230 corresponding to potential wells 225 and 226. FIG. 10G shows a sequence in time 232 of additive packets as they form and propagate down the traveling wave channels. It is like a multiple exposure photograph with 25 microseconds between each exposure. A small packet begins to form 233, grows to full size 234, and is passed into transport region 192 of the imaging array. A larger packet 235 forms independently in the adjacent channel, grows to full size 236, and similarly passes into the transport region of the array. Packet formation is centered on the imaging electrodes in the imaging region, and packets are confined between barrier electrodes in the transport region.

FIG. 11 illustrates negative imaging of the toner packets. A full packet is initially formed in each traveling wave channel, and then a pre-determined portion of the packet is diverted back to the donor roll and the undiverted portion is transported toward the receiving sheet 11. FIG. 11A shows a full toner packet 135 moving on surface 137 of a traveling wave channel. These packets have been formed by adding particles at a phase electrode during the loading process. Phase electrodes such as 133 are shown for moving the packets. A special diverter electrode 250 marked DIV is shown in a position normally occupied by a phase electrode. An instant in time labeled tDIV, 251, is associated with a line through the packet at the leading edge of the diverter electrode. In this embodiment, the diverter action will separate the packet into two smaller packets at the line marked by tDIV. In the figure, separation occurs at the midpoint of the packet. FIG. 11B is a snapshot taken approximately 25 microseconds later. Undiverted portion 252 is now at the Φ3 electrode and is proceeding with velocity 136 toward the receiving sheet. Diverted portion 253 has been ejected with a velocity 254 away from surface 137, and is collected by the donor roll. FIG. 11C shows the toner mass profile as a toner packet such as 135 passes by the leading edge of diverter electrode 250. Depending on the timing of tDIV, packet 135 can be sliced in various proportions, providing multiple levels of undiverted packet size in the preferred embodiment. In FIG. 11C, if diverter action is initiated at tDIV equals t0 or sooner, all toner is diverted. At t1, level 1 gray scale is achieved; at t6, level 6 gray scale is achieved, and so on. FIG. 11D shows a time sequence 260 of subtractive packet formation, where the snapshots of toner packets are taken after 25 microseconds, 175 microseconds, and 250 microseconds, referred to t=Ø. Trace or lead 261 from a high voltage driver connects to diverter electrode 250. It is shown passing underneath the phase electrode until it reaches the diverter electrode 250; thus potential interference to packet formation by this connecting trace is minimized by the attenuating effect of the intervening thin film layers. As previously described, each cycle of the toner loading creates small packets 194 that grow to full size packets 195, one for each traveling wave channel. Depending on the timing of diverter action in each channel, packets 195 are subtractively imaged by the diverter electrodes to create packets 262, 263, and 264. As previously discussed, diverted toner particles are collected on the donor roll and recycled.

Figure 12:
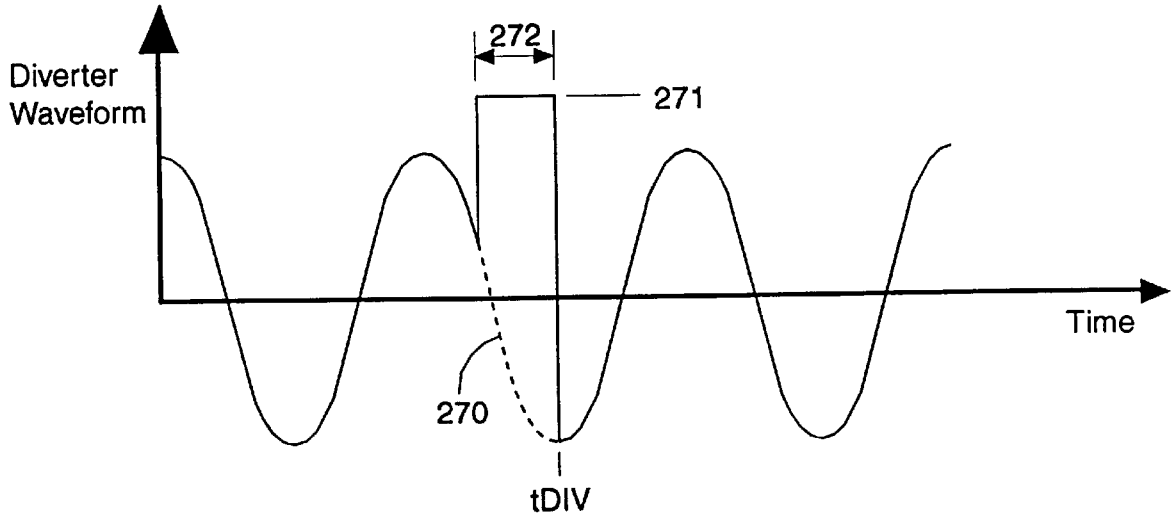
FIG. 12 shows an example of a diverter waveform as a plot of voltage versus time.

FIG. 12 shows a typical voltage waveform applied to a diverter electrode. At time tDIV, the diverter voltage departs radically from the background sinusoidal value of a phase electrode shown by 270, and moves abruptly to a strong repelling value 271, around +200 volts in the preferred embodiment. Value 271 is maintained for an interval 272 of around 60 microseconds, just long enough to ensure that all of the trailing edge of the packet has been diverted, then the diverter waveform is restored to the background phase voltage.

Figure 13:
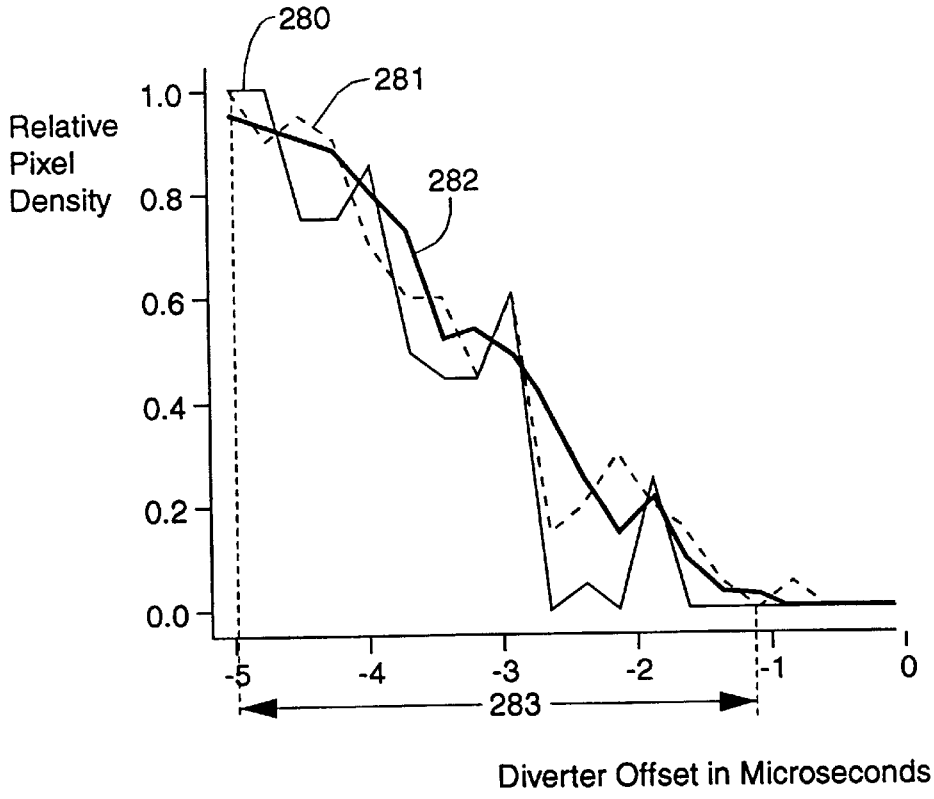
FIG. 13 shows computer simulated transfer functions for a diverter.

FIG. 13 shows a set of transfer functions for a diverter, based on computer simulation. Relative pixel density is plotted against diverter offset time in microseconds. Curves 280 and 281 were each obtained for a population of 10 particles in a packet, although the runs were independently produced to compare statistical variations for this packet size. Curve 282 was obtained for a packet population of 100 particles, and is smoother than the other two curves, demonstrating that packets with more particles can be subdivided more effectively. The preferred embodiment has approximately 150 particles in a full size packet, and so the predicted transfer response will approach a straight line. Also, the range 283 of diverter offset times is around 4 microseconds, which provides around 250 nanoseconds for the writing head logic circuits and driver circuits to discriminate each of the sixteen gray levels in the preferred embodiment. The rise and fall times for the diverter control voltage are around 40 nanoseconds in the preferred embodiment.

Figure 14A:
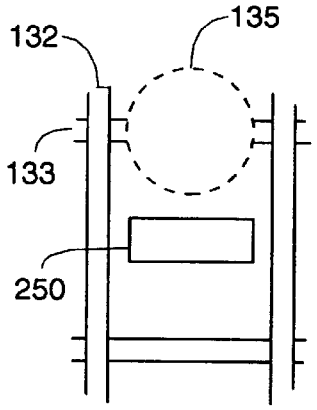
FIG. 14A shows an expanded plan view of a portion of a traveling wave channel, showing straight phase electrodes and a straight diverter electrode.
Figure 14B:
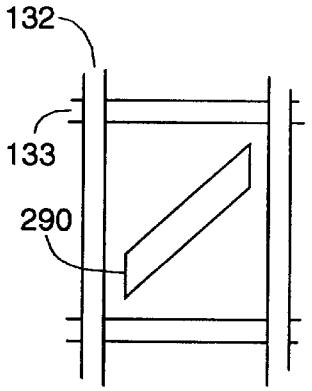
FIG. 14B shows an expanded plan view of a portion of a traveling wave channel, showing straight phase electrodes and a slanted diverter electrode.
Figure 14C:
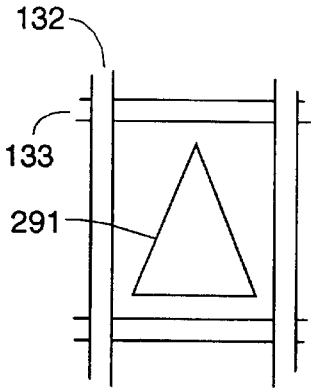
FIG. 14C shows an expanded plan view of a portion of a traveling wave channel, showing straight phase electrodes and a triangular diverter electrode shaped symmetrically to the toner path.
Figure 14D:
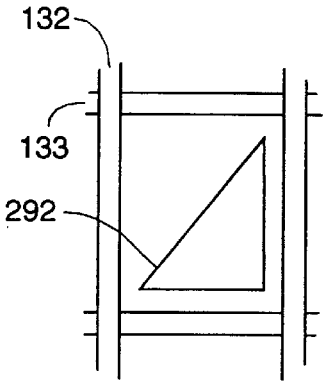
FIG. 14D shows an expanded plan view of a portion of a traveling wave channel, showing straight phase electrodes and a right-triangle-shaped diverter electrode.
Figure 14E:
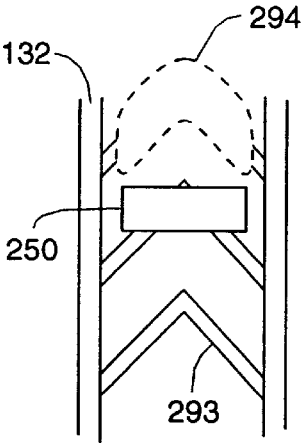
FIG. 14E shows an expanded plan view of a portion of a traveling wave channel, showing phase electrodes with a chevron shape and a straight diverter electrode.

So far, all the phase electrodes and diverter electrodes discussed have been straight, and perpendicular to the toner path. An advantage may be gained by shaping either or both of these electrodes, or changing their angle relative to the toner path. Some examples are shown in FIG. 14. FIG. 14A shows straight phase electrodes 133 and straight diverter electrodes 250, as previously described. FIG. 14B introduces a slanted diverter electrode 290, which can divert different lateral portions of the packet at different times. This can lengthen the range of diverter offset time from around 4 microseconds for a straight electrode to around 40 microseconds for a slanted diverter, potentially enabling many more gray scales to be produced. FIG. 14C shows a diverter electrode 291 shaped as a triangle, symmetrical to the direction of toner flow. The leading edge of the triangle is pointed, potentially enabling an improvement in the accuracy of imaging very small packets by limiting the portion of the packet exposed to the diverter action. FIG. 14D shows a diverter electrode 292 shaped as a right triangle, combining the effects of the slanted electrode with the effects of the symmetric triangle electrode. FIG. 14E shows chevron shaped phase electrodes 293 that will tend to create chevron-like toner packets 294. The extended length of these packets may also make it possible to create more toner slices or levels, in this case using a straight diverter electrode such as 250.

Figure 15A:
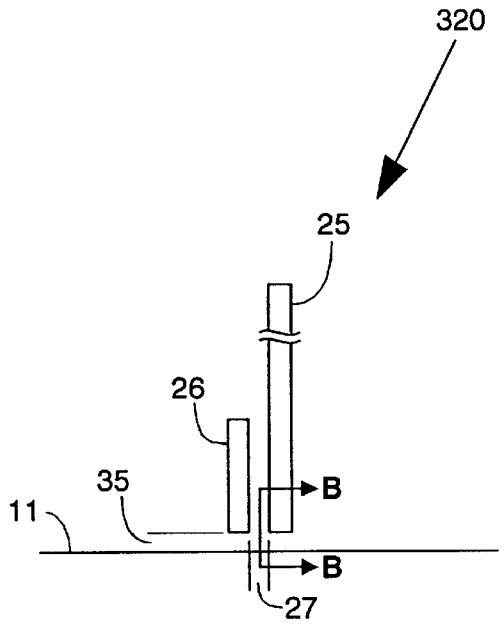
FIG. 15A is a side-elevational view of a transfer subsystem of the present invention, including an opposing print head.
Figure 15B:
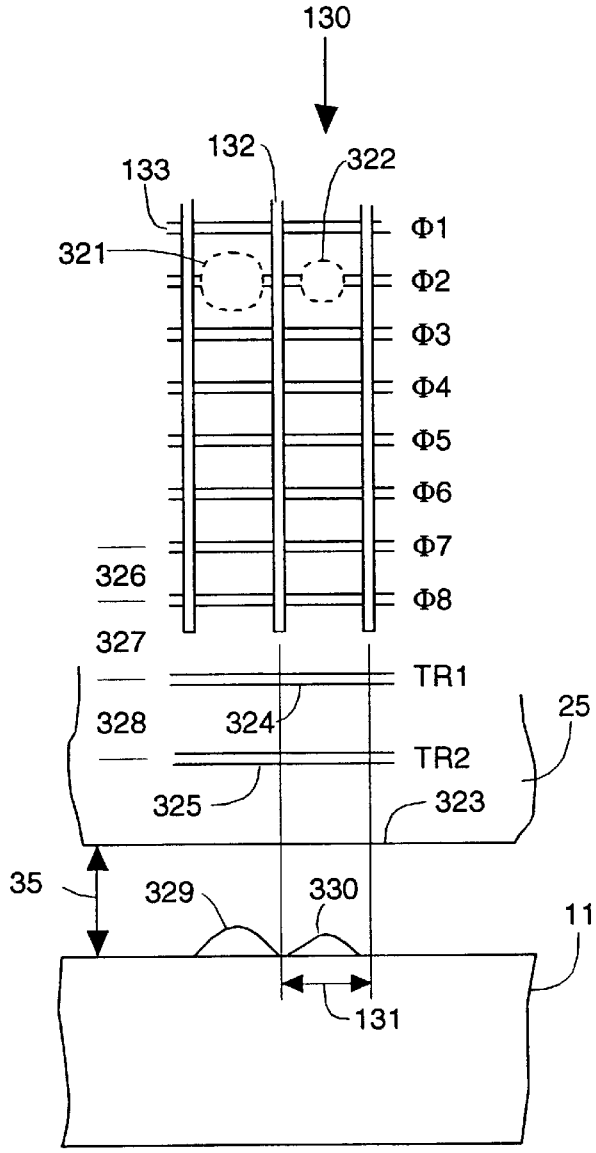
FIG. 15B is an expanded plan view of the portion BB of FIG. 15A.
Figure 16A:
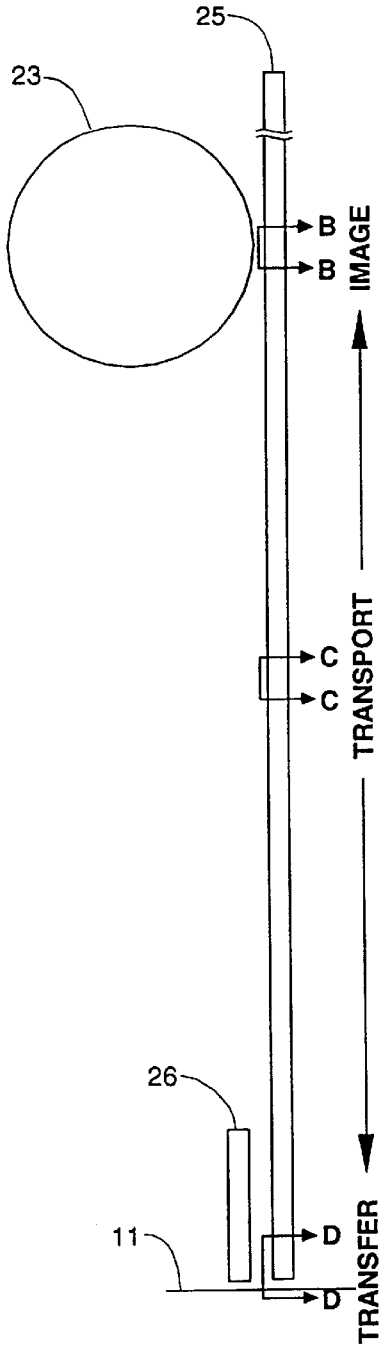
FIG. 16A is a schematic side-elevational illustration of the toner path from donor roll to receiving sheet, showing the sub-processes encountered by the toner particles.
Figure 16B:
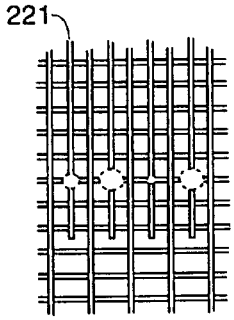
FIG. 16B is an expanded plan view of a portion of the thin film structure designated BB in FIG. 16A, showing the details for additive imaging.
Figure 16E:
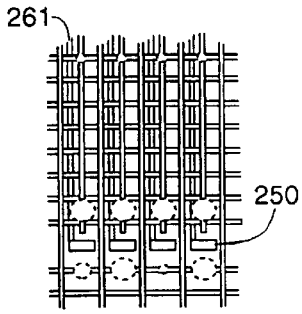
FIG. 16E is an expanded plan view of a portion of the thin film structure designated BB in FIG. 16A, with the details shown for subtractive imaging instead of additive imaging.
Figure 16C:
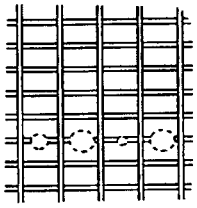
FIG. 16C is an expanded plan view of a portion of the thin film structure designated CC in FIG. 16A.
Figure 16D:
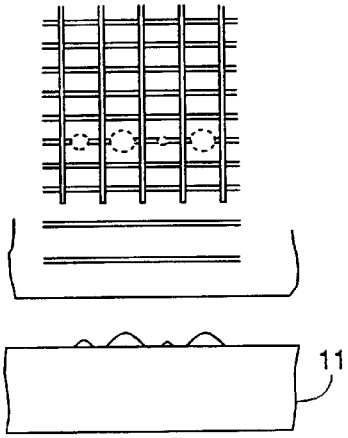
FIG. 16D is an expanded plan view of a portion of the thin film structure designated DD in FIG. 16A.

Packet size and image formation on single traveling wave channels by additive and subtractive methods has been described. Now it is necessary to transfer the imaged particles from the writing head to the receiving sheet. It is desired to do this at the pixel level, with each traveling wave channel delivering imaged toner to a corresponding pixel site on the receiving sheet. FIG. 15A shows transfer assembly 320 of the present invention. Assembly 320 consists of writing head 25 with special transfer electrodes to be described, and opposing head 26. The heads are separated by head gap 27. Transfer gap 35 exists between the heads and receiving sheet 11. The large opposing transfer electrode or head 26 is at ground potential and screens any extraneous electric fields that might otherwise interfere with toner transfer performance. FIG. 15B shows an expanded view of the portion BB of FIG. 15A. Two traveling wave channels are shown with toner packets 321 and 322 that have been imaged by one of the methods previously described. Near transfer edge 323 are two special transfer electrodes 324 and 325, labeled TR1 and TR2 respectively. Compared with spacing 326 between phase electrodes, spacing 327 to electrode TR1 and spacing 328 between TR1 and TR2 is slightly increased. In operation, packets 321 and 322 propagate toward transfer edge 323 at packet velocity 136, moving synchronously with the traveling wave as previously described. The objective at the transfer step is to faithfully transfer packets to corresponding pixel sites on receiving sheet 11 without losing any particles and without any cross-talk between channels or pixel sites. It is useful to terminate barrier electrodes 132 prior to transfer edge 323 in order to maximize the field-planarizing effect of electrodes TR1 and TR2. The ideal transfer field is one-dimensional, with no local disturbances. Electrodes TR1 and TR2 are used to accelerate the packets to the paper, and also to bunch the packets tightly together. It has been observed that bunching the packets, which is the same thing as limiting the spread of phase among the toner particles in a packet, provides better transfer performance. Particles leaving the writing head at transfer edge 323 have an angle of trajectory to the plane of the writing head surface. This trajectory angle varies with particle phase, and limiting the variation in phase limits the variation in trajectory angle. For maximum phase-bunching effect TR1 and TR2 may be connected to DC voltage levels or to voltage pulses that are synchronized to the traveling wave. Toner piles 329 and 330 corresponding to packets 321 and 322 are formed on receiving sheet 11 after transfer. The preferred approach is to minimize transfer gap 35, and thus to minimize packet spreading during transfer. A small amount of packet spreading is inevitable because the particles are mutually repelling in the transfer gap. The goal is to keep gap 35 to a dimension similar to pixel size 131, which is 42 microns in the preferred embodiment. This gap must be maintained across the full print width, and this generally requires precision components on both sides of the transfer edge.

FIG. 16 is presented as a means to collect together all of the preceding processes and thin film structures, and show how each contributes to the toner packet delivery. FIG. 16A is a summary view of the entire toner path except for fusing. FIG. 16B shows the thin film structure for additive imaging including additive electrodes such as 221. FIG. 16C shows the thin film structure for transport. FIG. 16D shows the special structures related to transfer. FIG. 16E shows the alternative thin film structure for subtractive imaging.

Figure 17A:
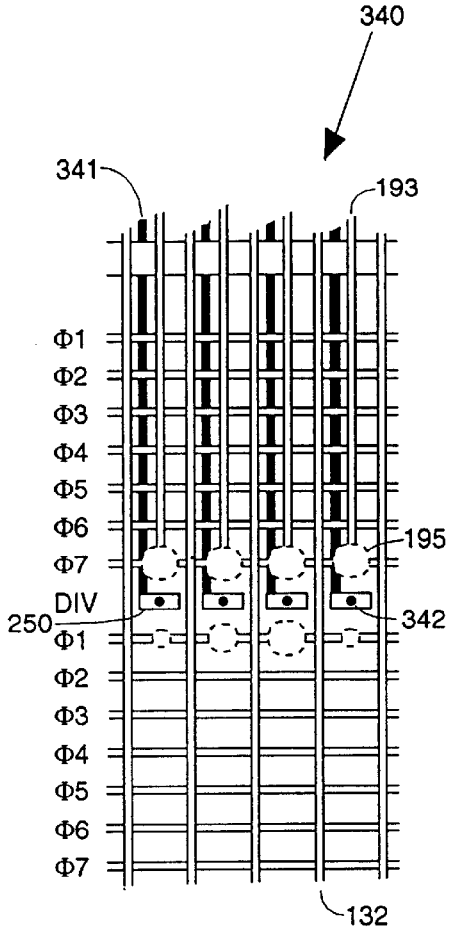
FIG. 17A shows the connecting traces from high voltage drivers to diverter electrodes for the un-multiplexed case.
Figure 17B:
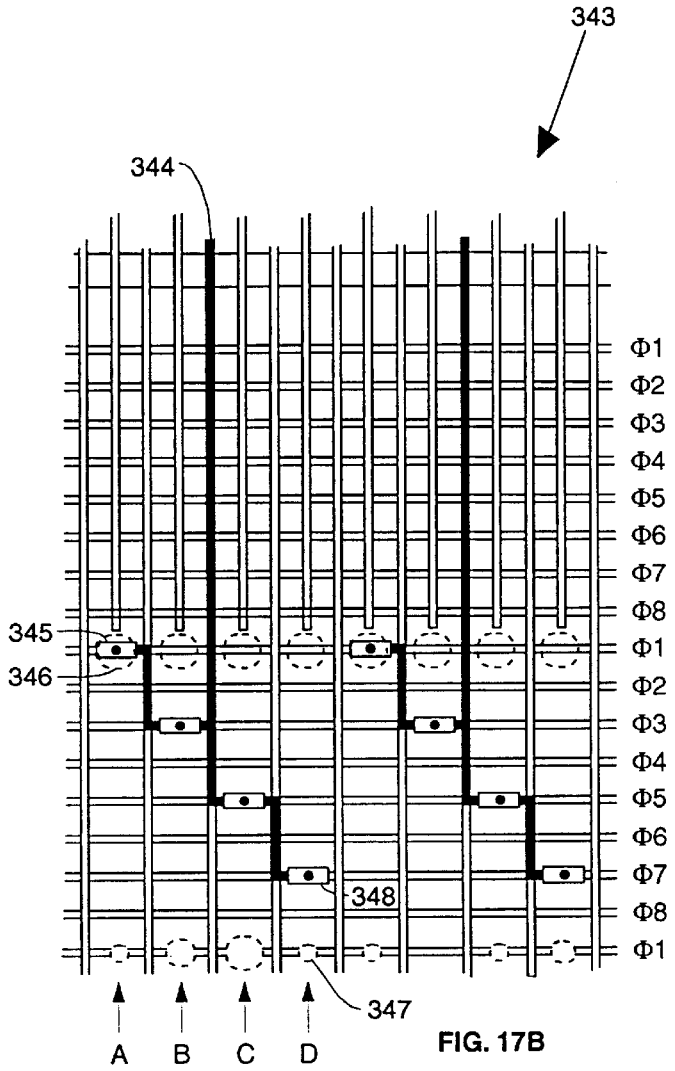
FIG. 17B shows the connecting traces from high voltage drivers to diverter electrodes for the case of 4-way multiplexing.

For the case of subtractive imaging, it may be desirable to reduce the manufacturing cost of the writing head by controlling more than one traveling wave channel diverter with a single high voltage driver. Since the packets on a traveling wave conveyor are widely separated, especially if the traveling wave is implemented with a large number of phases such as 8 phases described herein, multiplexing a single high voltage driver to multiple channels is possible. FIG. 17A shows the unmultiplexed version 340. Conductive trace 341 is colored black and connects between a high voltage driver and diverter electrode 250 in the traveling wave channel. Trace 341 is shown routed underneath the phase electrodes. In a 3-layer metalization scheme for manufacturing the writing head, to be described, it would be routed on the first and bottom-most metal layer, and fields created by trace switching during diverter action would be substantially attenuated at the imaging surface. A via 342 connects between trace 341 on metal layer 1 and diverter electrode 250 on metal layer 3. In the preferred embodiment, barrier electrodes 132, loading electrodes 193, and diverter electrodes 250 are implemented on metal layer 3. FIG. 17B shows the multiplexed version 343. Conductive trace 344 is also colored black and connects between a single high voltage driver and four diverter electrodes like 345. In order to see the complete routing for trace 344 it is shown in black as the topmost layer. In reality however, it is implemented on the metal 1 layer so that its effect will be attenuated at the surface. Outlines of full sized packets such as 346 are shown at the second set of Φ1 electrodes. The packet in the channel marked A is imaged at Φ1 time, when Φ1 is peaking negatively. The packet in the next channel marked B is imaged at Φ3 time when Φ3 is peaking negatively. Similarly, packets in channels marked C and D are imaged at Φ5 and Φ7 times respectively. The barrier electrodes provide isolation between adjacent channels so that toner ejection in one channel does not affect transport of a packet in an adjacent channel. Within a single channel such as the channel marked D, it can be seen that the previously imaged packet 347 at Φ1 has a phase electrode (Φ8) interposed between it and the active diverter electrode 348. Diverter electrode 348 will be active at Φ1 time, since it is physically connected to diverter electrode 345. By interposing at least one regular phase electrode between any active diverter and any packet in the same channel that is intended to be unaffected by the diverter action, multiplexed diverting can occur without degrading the packets already formed. This is because the interposed phase electrode screens the disturbance of diverter action from the previously imaged packet. The same isolation occurs between diverter action and packets that are yet to be imaged in the same channel. Finally, the multiplexed diverter action of FIG. 17B can proceed at full process speed; i.e., there is no compromise in printing speed with this 4-way multiplexing scheme.

Figure 18:
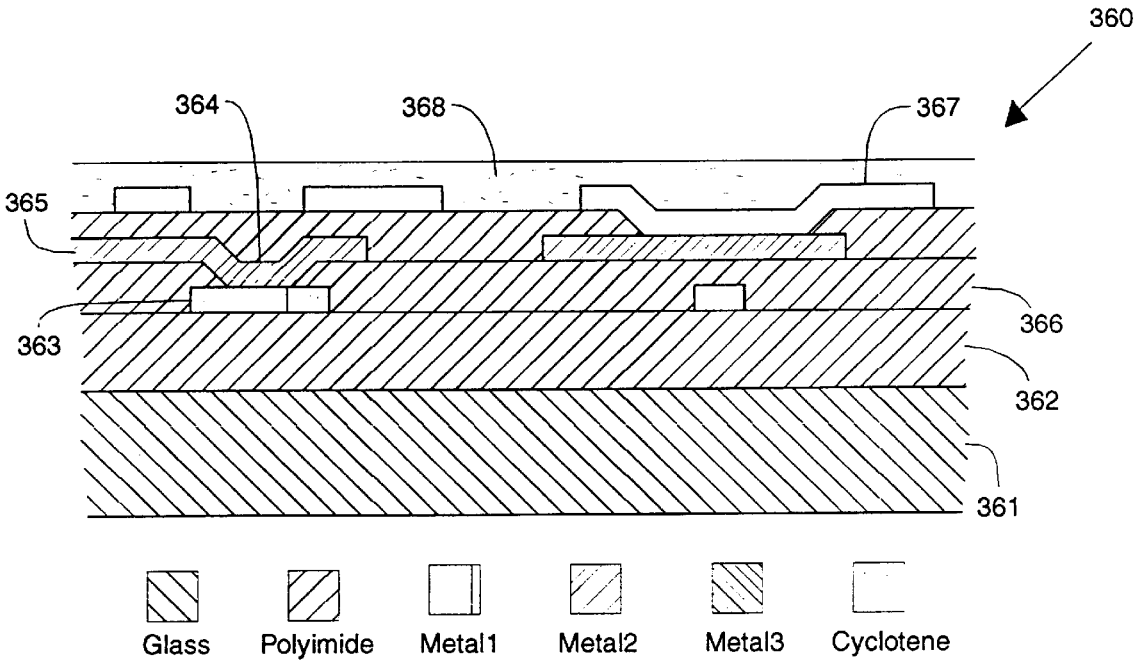
FIG. 18 shows a schematic cross sectional illustration of an example thin film structure in accordance with one embodiment of the present invention.

FIG. 18 shows a cross-section 360 of a generic thin film structure such as employed in the present invention. Substrate 361 is glass in the preferred embodiment, but silicon, printed circuit board laminate, ceramic, and aluminum can also be used. A base layer 362 of dielectric material such as polyimide may be provided to planarize the substrate surface and cover surface defects. The metal layer 363 is a sputtered tantalum film with a thickness of around 0.12 microns. Tantalum metal has the advantage that it is chemically resistant to attack by typical air-borne contaminants. A thickness of around 0.12 microns is an adequate thickness in the application, because very low currents are required. The thinness of the metal makes patterning easier, and sputtered films provide good coverage of inter-layer vias such as 364 that connect between metal layers. Base layer 362 and inter-dielectric layers such as 366 are all fabricated with a dielectric material such as polyimide or silicon oxy-nitride.

Inter-dielectric layers such as 366 are around 2 microns thick in the preferred embodiment. The breakdown voltage of polyimide and oxy-nitride material is around 300 and 500 volts per micron respectively, more than adequate to sustain the working voltages. Metal2 and Metal3 layers 365 and 367 are similar in thickness and composition to Metal1.

The thin film structure for additive imaging requires only two layers of metal. The first layer includes the phase electrodes, and the second layer includes barrier electrodes and additive imaging electrodes. In FIG. 18 the phase electrodes would be on the Metal1 layer 363, and the barrier and imaging electrodes would be on the Metal2 layer 365. Vias such as 64 would connect between metal interconnect traces at the periphery of the imaging array 53, whereby signals are fed into the array.

Figure 11A:
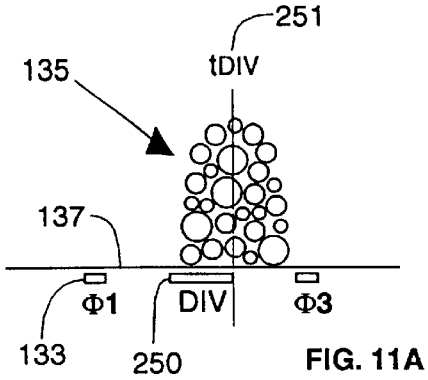
FIG. 11A is a side-elevational view of a toner packet passing over a diverter electrode.
Figure 11B:
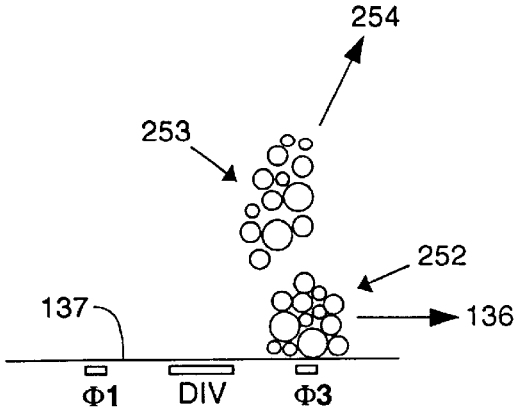
FIG. 11B is a side elevational view of two sub-packets formed by diverter action.
Figure 11C:
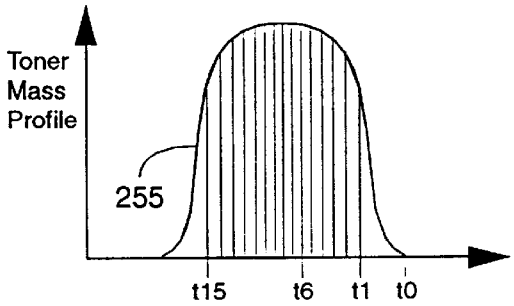
FIG. 11C shows a profile of toner mass versus time for a packet.
Figure 11D:
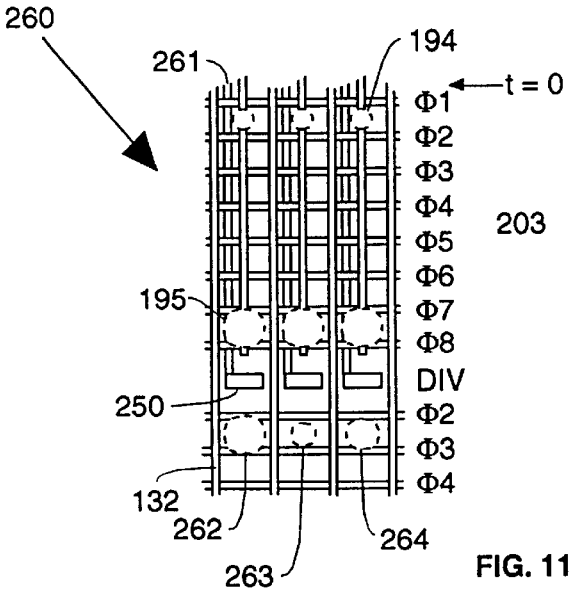
FIG. 11D is a plan view illustration of a time sequence of packet forming events using the subtractive imaging process.

Subtractive imaging requires an additional layer to feed the diverter electrodes as described in FIG. 11D. This additional layer would become the Metal1 layer 363. The phase electrodes would then move to Metal2 layer 365, and the barrier and loading electrodes to Metal3 layer 367. The final topcoat layer 368 is Cyclotene in the preferred embodiment. Cyclotene is manufactured by Dow Chemical and is a polymer that is also known as BCB. BCB is a contraction of B-staged bisbenzocyclobutane. Its value as a topcoat lies in its triboelectric behavior. As toner particles interact with the imaging surfaces of the present invention, it is important that the particle charge does not change significantly. Such a change would lead to unpredictability in the toner behavior. Cyclotene has been observed to be essentially charge neutral to many toners, allowing continuous operation without degradation of printing performance. Its planarizing properties help to provide flat imaging surfaces that are preferred over bumpy surfaces, and it is impervious to water. A related benefit of Cyclotene is that it enables a self-cleaning surface. Traveling wave channels will be subjected to small amounts of debris in the form of paper dust, dirt, and poorly charged toner. It has been observed that the flux of imaged toner carries the debris with it. Considering the small amounts of debris in a working printer this is desirable, because the contaminants get deposited on the receiving sheet where they will have little effect on the printed image. This is preferable to having the particles collect on the imaging surfaces, where over time, they may negatively impact the imaging function. Also, a non-self-cleaning surface will require separate apparatus and controls to perform the cleaning function.

Figure 19:
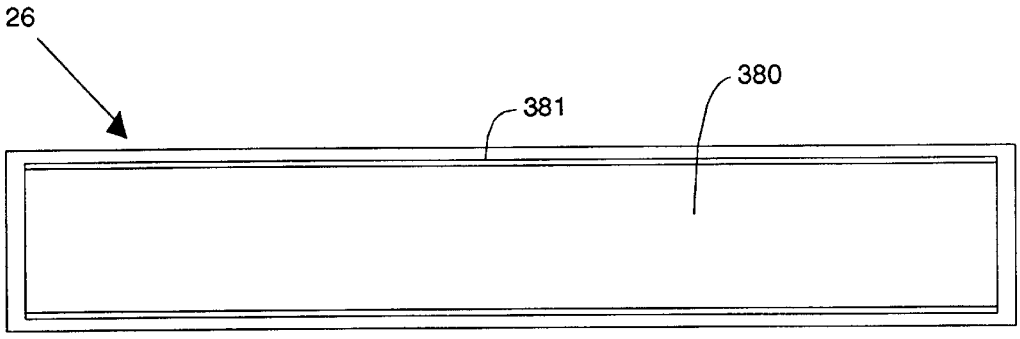
FIG. 19 is a plan view of an opposing print head with a heating resistor that serves also as a large transfer electrode.

A potential improvement to the transfer apparatus described in reference to FIG. 15A is to soften the toner particles by heating them for the last few millimeters of travel prior to leaving transfer edge 323 of the writing head. When imaged particles traverse transfer gap 35, they impact on receiving sheet 11 and bounce before settling on the surface. Bouncing is generally undesirable and tends to degrade image quality by mixing toner piles at neighboring pixel sites. FIG. 19 shows opposing print head 26 with a heating resistor 380 extending between two conducting electrodes such as 381, fabricated on any suitable substrate such as ceramic or FR5 printed circuit board laminate. Heating resistor 380 replaces the large grounded transfer electrode previously discussed. It can be manufactured as a thick film resistor, or a thin film resistor such as tantalum nitride. The fact that there is a small change in voltage from top to bottom of resistor 380 will not materially affect the transfer behavior. Thermal sensors and control circuits (not shown) should be employed to control the temperature in the opposing head gap 27 to an ambient of approximately 120 degrees Centigrade. Toner particles will typically melt at this temperature if given sufficient time, but the purpose is just to soften them during their brief period of transit to the receiving sheet. The softened particles will bounce less, and they will be more easily fused in a subsequent step.

Figure 20:
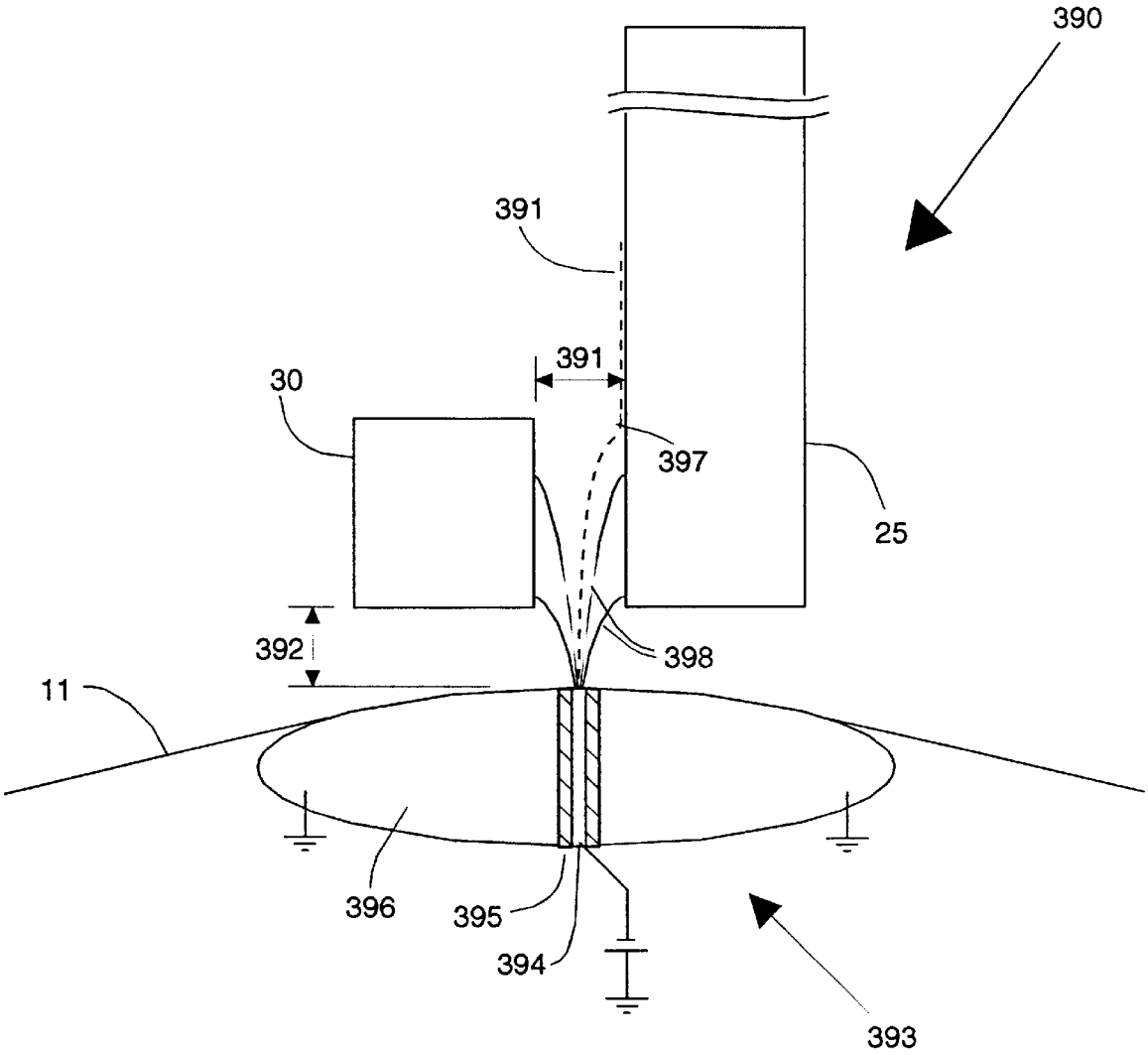
FIG. 20 is a schematic side view of a second alternative embodiment for transfer, characterized by a large transfer gap and including focusing electrodes.

FIG. 20 shows a second alternative packet transfer apparatus shown as 390. Opposing head gap 391 and transfer gap 392 have each been increased to a distance of approximately one millimeter. Transfer shoe assembly 393 is provided on the back side of receiving sheet 11. Shoe 393 includes a blade electrode 394 that is biased to a toner-attracting potential, and is separated by thin dielectric sheets 395 from wing electrodes 396 that are grounded. This arrangement implements an electrostatic lens. A special diverter electrode (not shown) at location 397 is employed to separate imaged packets from the writing head surface. A grounded planar electrode (not shown) is provided on writing head 25, extending from location 397 to the bottom edge. Electric fields 398 focus the toner path such that toner is attracted to pixel sites on the receiving sheet that are directly in front of the blade electrode. As a consequence of the larger transfer gap 392, components of high precision are no longer required at the transfer edge, and it is relatively easy to maintain a large gap of around one millimeter along the entire width of the imaging array.

The most common receiving sheet material is paper. It is generally difficult to maintain a very small transfer gap between any mechanical assembly and paper, because the paper surface is unpredictable. For example it can shrink or expand depending on moisture content, and it can deform if there are imperfections in the paper transport mechanism. Consequently, it may be advantageous to transfer first to a precise rigid body in the form of an intermediate offset roll, with a very small gap, and then to transfer using direct contact from the offset roll to the paper. Another motivation to use an offset roll is that it can enable printing on substrates that are not flat, for example a soda can. Also, the offset roll may facilitate printing on fabrics and other materials where physical contact and pressure against the print medium helps to impregnate the print medium with toner ink. For example, if the offset roll is heated, the imaged toner transferred from an offset roll to a fabric medium may behave more like an offset printing paste than dry toner powder—a potentially significant advantage.

Figure 21:
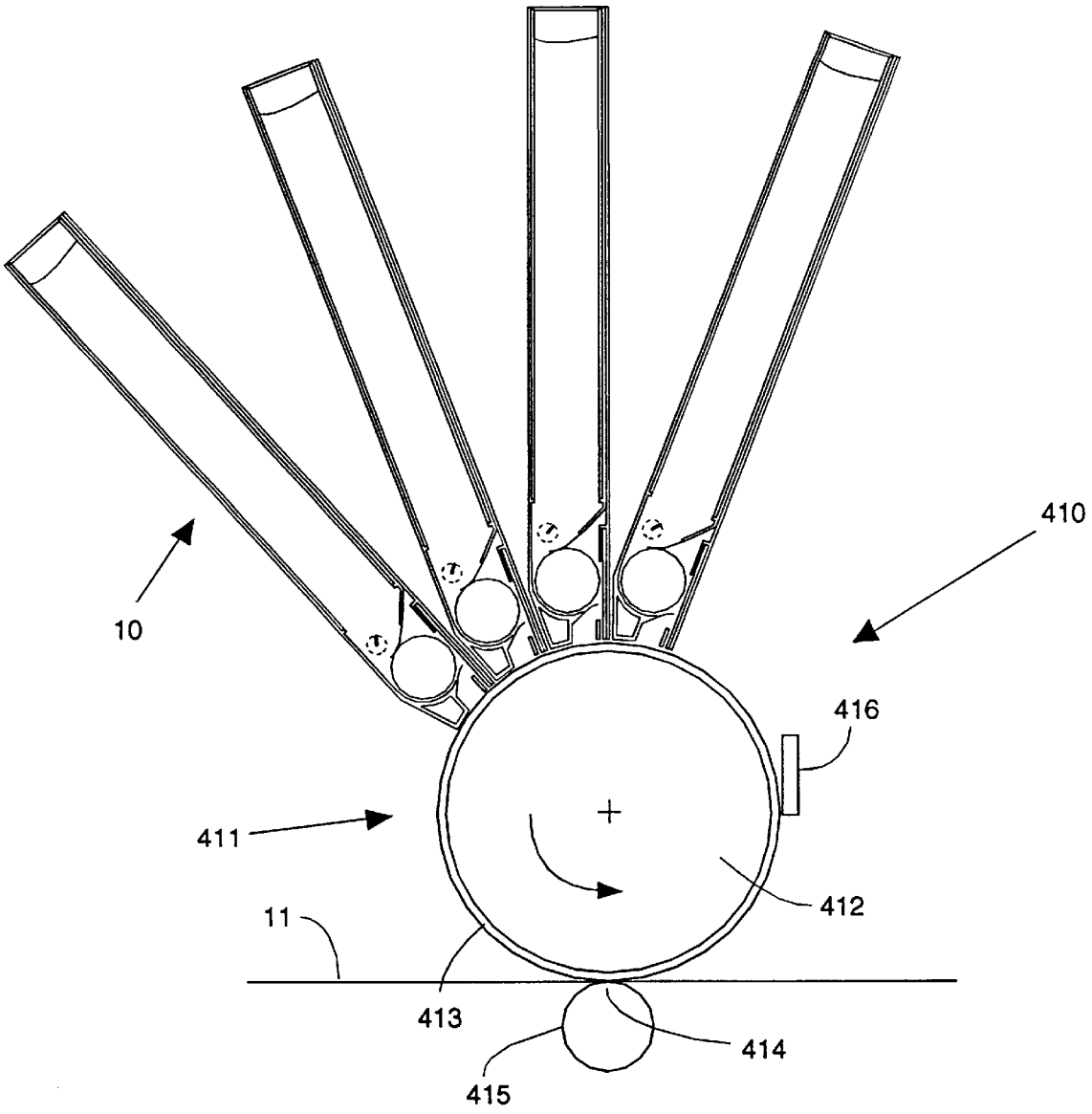
FIG. 21 is a side-elevational view of a third alternative embodiment for transfer, utilizing an intermediate offset roll.

FIG. 21 illustrates a third alternative transfer apparatus of the present invention, shown as 410. Four print cartridges 10 are arrayed around offset roll 411. Roll 411 has an inner conductive region 412 that is biased (not shown) to attract toner from the writing head, and a dielectric sleeve 413 at its outer periphery. Sleeve 413 may be manufactured of a compliant material such as rubber, and/or a toner-releasing material such as Teflon. Also, roll 411 may be heated to soften the toner particles and reduce bouncing as the particles arrive from the writing heads, and also to assist contact transfer at transfer nip 414. After transferring to the surface of the offset roll, imaged toner particles rotate around until transferred to receiving sheet 11 at nip 414. Transfer backup roll 415 provides pressure for the contact transfer, and is also biased (not shown) to attract toner off of roll 411. A cleaning blade 416 scrapes any un-transferred residue off of the surface prior to accepting more toner from the writing head. Finally, either or both of rolls 411 and 415 may be heated sufficiently that a transfix process is implemented. That is, the hot roll fusing apparatus is integrated with the offset roll transfer apparatus, thus eliminating a separate fusing device.

Referring to FIG. 15A and FIG. 20, it may be desirable in some applications to provide a traveling wave conveyor on the opposing print head. By synchronizing the traveling waves on the writing head and the opposing head, precise control of the toner packets is achievable.

Figure 22:
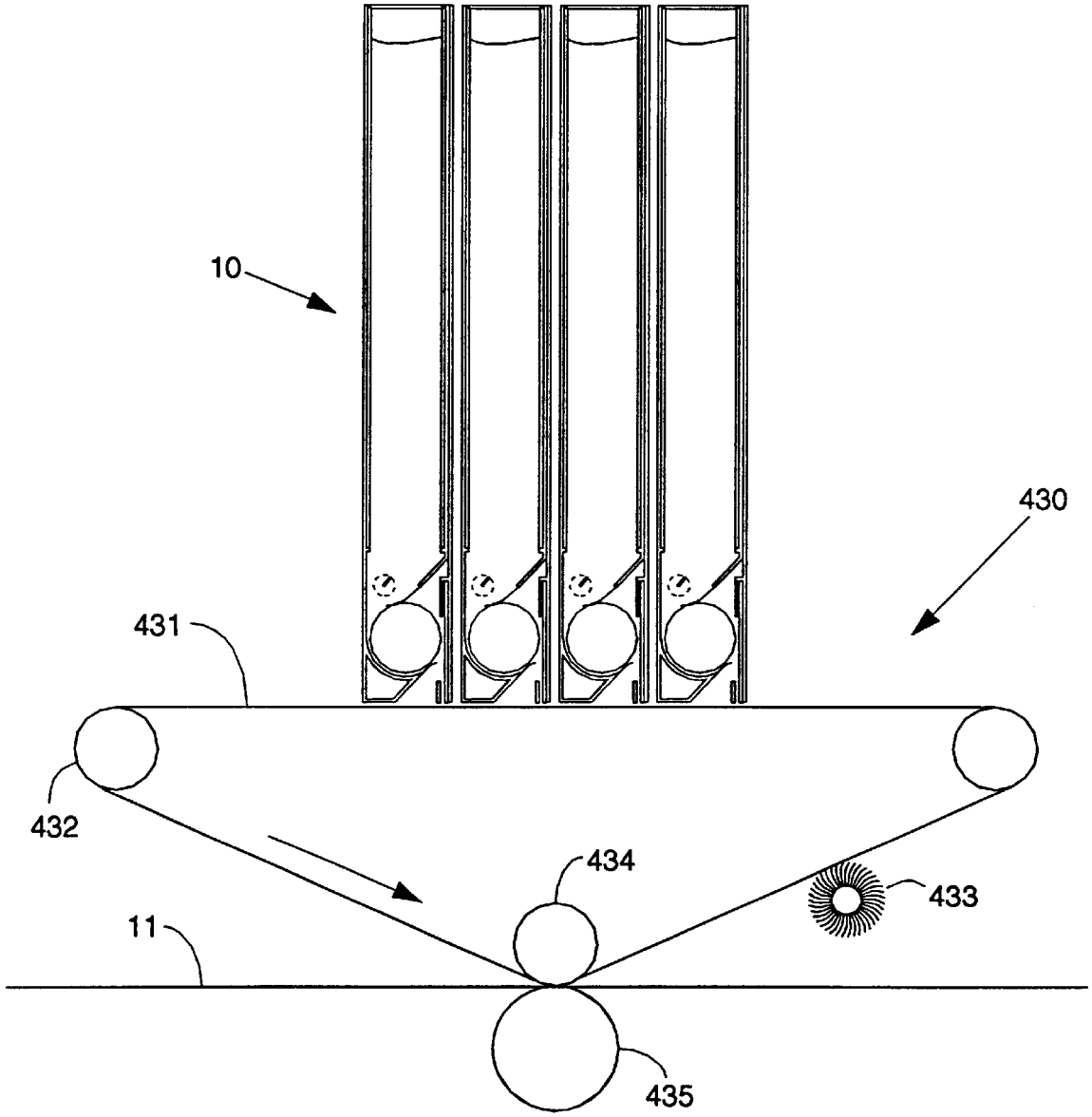
FIG. 22 is a side-elevational view of a fourth alternative embodiment for transfer, utilizing an intermediate transfer belt.

FIG. 22 illustrates a fourth alternate transfer apparatus 430 of the present invention. Four print cartridges 10 are arrayed above a transfer belt 431 that is stretched over rollers such as 432. The four cartridges write to the belt in a synchronized manner such that the colors are superimposed with correct registration. The belt is constructed from a base material such as polyimide and is typically laminated with an elastomer. The elastomer may have a conductive filler to improve its ability to dissipate high temperatures associated with a hot fusing roll. The transfer belt also has a release material such as Teflon on the toner-accepting surface. The underside of the belt has a conductive layer that is biased to aid transfer of toner from the writing heads, as is known in the art. After contact transfer of the color image from belt 431 to receiving sheet 11, the belt is cleaned with brush 433 before accepting a new toner image. Rolls 434 and 435 are heated to implement a transfix function, thus eliminating a separate hot roll fuser.

It should be apparent by the teaching of the invention that voltage traveling wave toner conveyors on a writing head can be configured with DC and AC bias circuits to load toner particles onto the head in a controlled manner and within a narrow loading region. Electrostatic toner loading can be further combined with imaging structures on the same writing head. Both additive and subtractive imaging methods and structures have been described. These structures and methods have broad applicability to printing machines. A few of the primary embodiments have been described in detail; other embodiments will be apparent to practitioners skilled in the art. Specifically, the following variations are included in this patent. The number of print cartridges or writing heads may be greater or fewer than four. For example, 6 color and 8 color printing machines may be attractive for high end applications, or a clear coating may be applied with one additional cartridge. The number of gray scales may be greater or fewer than sixteen, perhaps as many as 256 levels. Print speeds substantially faster than 40 ppm are possible with the traveling wave methods described herein, also slower speeds may be appropriate in some applications. Print widths greater or less than 12 inches are easily achieved, because the apparatus is scalable in print width. Print widths of one inch or less may be attractive in low cost applications. Resolutions greater than 600 dpi are achievable with modern photolithographic methods. Resolutions less than 600 dpi may be appropriate in some applications. The wavelength of the traveling waves may be greater or less than 200 microns. For example, wavelengths as short as 30 microns have been demonstrated to effectively convey toner; wavelengths greater than 200 microns may be appropriate for printers with a large number of gray scales such as 256 density levels of each color. The number of phases applied to the traveling wave conveyors may be greater or fewer than eight. Three phases are the minimum number, more than eight may be desirable to enable greater levels of multiplexing. The electrode sizes, shapes, and spacings may be varied. The opposing, print head may include traveling wave conveyors. The thin film materials used in writing head manufacture may vary. For example, aluminum or aluminum alloys or other metals may be used in place of tantalum conductors. Other dielectrics can potentially be used in place of polyimide, oxy-nitride and Cyclotene. Greater or fewer than three layers of metal may be employed. The traveling wave conveyors described herein have been observed to effectively transport liquid toners, comprised of charged colored particles in a clear liquid carrier. This patent covers dry toners including attrited and polymerized types, and liquid toners. The additive and subtractive imaging methods may also be extended by packet size. The preferred embodiment employs one packet per pixel. However, multiple smaller packets may be counted and delivered to a pixel site to render an image. Print algorithms that operate on variable and constant packet sizes are included in this patent. Other embodiments will be apparent to practitioners skilled in the art.

What is claimed is:

1. A printing apparatus for supplying toner particles from a toner source to pixel sites on a toner receiving surface to form images on said surface including:

a writing head having a toner packet forming region for forming a toner packet for each pixel site, a toner packet transport region, and a toner packet transfer region having one transfer end for delivering toner packets to individual pixel sites on said toner receiving surface, a toner delivery system disposed adjacent said writing head for delivering toner to said toner packet forming region of said writing head, said toner packet forming region including toner control means for controlling an amount of toner in each toner packet and delivering the packets to said toner packet transport region whereby the packet supplied at each of said pixel sites on said receiving surface forms a pixel having a depth corresponding to the amount of toner delivered in the corresponding packet.

2. A printing apparatus as in claim 1 in which said toner control means for controlling the amount of toner delivered to each toner packet from said toner delivery system comprises electrodes.

3. A printing apparatus as in claim 1 in which said toner control means for controlling the amount of toner delivery to each toner packet from said toner delivery system comprises electrodes which divert toner away from toner packets formed in said packet forming region.

4. A printing apparatus as in claims 1, 2 or 3 in which said toner delivery system includes a toner delivery member and means for applying a DC and an AC voltage between said toner delivery member and said packet forming region.

5. A printing apparatus as in claims 1, 2 or 3 including at least one electrode spaced between the end of the toner particle transfer region and the toner receiving surface.

6. A printing apparatus for supplying toner particles from a toner source to pixel sites on an image receiving surface of predetermined width to form images on said surface including:

a writing head having a toner packet forming region, a toner packet transport region and a toner packet transfer region having a transfer end for delivering toner packets to individual said pixel sites on said image receiving surface, said writing head having a plurality of spaced parallel transport electrodes extending substantially coextensive with the width of said image receiving surface, a source of AC multiphase voltage connected to said electrodes to form a traveling wave for transporting toner packets, a plurality of spaced barrier electrodes extending substantially perpendicular to said transport electrodes to form a plurality of side-by-side packet transport channels in said toner packet transport region, said barrier electrodes also forming a plurality of side-by-side channels in said toner packet forming region, a toner delivery system including a donor delivery member disposed adjacent said multichannel toner packet forming region for delivering toner to each of said channels, said toner forming section including toner control means for independently controlling the amount of toner in the packets in each of said channels in said packet forming region and for delivering the packets to the corresponding channel in said toner transport region whereby each of the toner packets delivered to said toner packet transfer region for delivery to the image receiving surface forms a pixel of selected depth.

7. A printing apparatus as in claim 6 in which said toner control means comprises electrodes in each of the channels in the packet forming region.

8. A printing apparatus as in claim 7 in which said electrodes extend along each channel.

9. A printing apparatus as in claim 6 in which said toner control means comprises electrodes in each of said channels for diverting toner particles away from packets formed in said packet forming section.

10. A printing apparatus as in claim 9 in which the electrodes extend across each channel.

11. A printing apparatus as in claims 8 or 10 in which the electrodes are linear.

12. A printing apparatus as in claim 10 in which the electrodes are shaped.

13. A printing apparatus as in claim 10 in which the electrodes in adjacent channels are multiplexed.

14. A printing apparatus as in claim 6 in which said spaced parallel transport electrodes are shaped.

15. A printing apparatus as in claims 1 or 6, and including a transfer head positioned facing the transfer end of said writing head.

16. A printing apparatus as in claims 1 or 6, and including a transfer shoe with electrostatic focusing electrodes opposite the transfer end of said writing head.

17. A printing apparatus as in claims 1 or 6, and including an offset roll positioned between the transfer end of said writing heads and said receiving surface.

18. A printing apparatus as in claims 1 or 6, and including a transfer belt positioned between the transfer end of said writing heads and said receiving surface.

19. A printing apparatus as in claims 1 or 6 and including means to heat the toner particles after said toner particles leave said writing head and before said toner particles contact said receiving sheet.

20. A printing apparatus as in claim 19 in which said substrate includes thin film transistors.

21. A printing apparatus as in claims 1 or 6 in which said electrodes are thin film electrodes carried on a substrate.

22. A printing apparatus as in claim 21 in which the thin film electrodes are tantalum or aluminum.

23. A printing apparatus as in claim 6 in which the writing head includes a topcoat thin film layer of Cyclotene.

24. A printing apparatus for supplying toner particles from a toner source to pixel sites on an image receiving surface of predetermined width to form images on said surface including:

a writing head having a toner packet forming region and a toner packet transport region having one end for delivering toner packets to said pixel sites on said image receiving surface, said writing head comprising a substrate having a plurality of spaced parallel thin film transport electrodes extending substantially coextensive with the width of said image receiving surface, a source of AC multiphase voltage connected to said electrodes to form a traveling wave for transporting toner packets, a plurality of spaced parallel thin film barrier electrodes insulated from and extending substantially perpendicular to said transport electrodes to form a plurality of side-by-side packet transport channels, said barrier electrodes also forming a plurality of side-by-side channels in said toner packet forming region, a toner delivery system including a toner delivery surface disposed adjacent said toner packet forming region for delivering toner to each of said channels, and thin film toner loading electrodes in each of said channels extending between and parallel to said barrier electrodes in the toner packet forming region for independently loading toner into the channels of said packet forming region to form packets of toner.

25. The printing apparatus of claim 24 including means for applying a control voltage between said loading electrodes and said toner delivery surface whereby the size of the toner packets is controlled.

26. The printing apparatus of claim 25 in which said control voltage forms full size packets and thin film diverter electrodes are provided in each of said packet transfer channels for diverting toner particles away from the full size packets.

27. A method of applying toner to an image receiving member to form a line of pixels each having a predetermined amount of toner which comprises the steps of:

conditioning a print head having a plurality of side-by-side columns of spaced imaging electrodes having a transfer end to control the size of toner packets formed in each column during a print cycle, supplying toner to said imaging electrodes whereby each of said toner packets are formed with a predetermined amount of toner, positioning said image receiving member adjacent a transfer end of said print head, conveying said toner packets along said columns to said transfer end, and transferring said toner packet to said image receiving member to form a pixel for each of said columns, each pixel having said predetermined amount of toner, with each of said print cycles creating a line of pixels.

28. A method of applying toner to an image receiving member to form a line of pixels each having a predetermined amount of toner which comprises the steps of:

positioning a toner source adjacent a print head having a plurality of side-by-side columns of spaced electrodes having a transfer end, applying voltage traveling waves to said electrodes to convey toner packets along said columns, applying a voltage to an imaging electrode in each of said columns to control the amount of toner loaded from said toner source to each of said packets in each of said columns to form packets with a predetermined amount of toner, positioning said image receiving member adjacent a transfer end of said print head, conveying said toner packets along said columns to said transfer end, and causing said conveyed toner packets to transfer to said image receiving member to form a pixel for each packet for each of said columns, each pixel having said predetermined amount of toner.

29. A method of applying toner to an image receiving member as in claim 28 including the step of diverting toner from the toner packets to control the packet size.

30. The method of printing as in claim 27, 28 or 9 including the step of providing relative movement between the image receiving member and the writing head to print a two-dimensional image.

31. A toner cartridge for supplying toner particles to an image receiving surface including:

a toner reservoir, a toner charging means, and a writing head having a toner packet forming region and a toner packet transport region for delivering toner packets to pixel sites on said image receiving surface, said toner packet forming region including toner control means for controlling the amount of toner in each toner packet and delivering the packets to said toner packet transport region whereby the packet or packets delivered to each of said pixel sites on said receiving surface forms a pixel corresponding to the amount of toner delivered in each packet.

32. A toner cartridge as in claim 31 in which said toner control means comprises electrodes for controlling the amount of toner delivered to said packet from said toner charging means.

33. A toner cartridge as in claim 31 in which said toner control means comprises electrodes which divert toner from packets formed in said packet forming region.

* * * * *